US005473727A

United States Patent [19]

Nishiguchi et al.

[11] Patent Number: 5,473,727

[45] Date of Patent: Dec. 5, 1995

[54] VOICE ENCODING METHOD AND VOICE DECODING METHOD

[75] Inventors: Masayuki Nishiguchi, Kanagawa; Ryoji Wakatsuki, Tokyo; Jun Matsumoto, Tokyo; Shinobu Ono, Tokyo, all of Japan

[73] Assignee: Sony Corporation, Japan

[21] Appl. No.: 146,580

[22] Filed: Nov. 1, 1993

[30] Foreign Application Priority Data

Oct. 31, 1992 [JP] Japan ..... 4-316259

[51] Int. Cl.[6] ..... G10L 5/00

[52] U.S. Cl. ..... 395/2.31; 395/2.1; 395/2.12; 395/2.17; 395/2.35; 381/36; 381/47

[58] Field of Search ..... 381/38, 47; 395/2.1, 395/2.12, 2.14, 2.16, 2.17, 2.31, 2.32, 2.35, 2.42, 2.77

[56] References Cited

U.S. PATENT DOCUMENTS

| | | | |
|---|---|---|---|
| 4,918,729 | 4/1990 | Kudoh | 395/2.35 |
| 5,073,940 | 12/1991 | Zinser et al. | 381/38 |
| 5,097,507 | 3/1992 | Zinser et al. | 381/47 |

OTHER PUBLICATIONS

Michael J. Sabin, "Product Code Vector Quantizers for Waveform and Voice Coding," IEEE Transactions on Acoustics, Speech, and Signal Processing, vol. ASSP–32, No. 3, Jun. 1984, pp. 474–488.

Daniel W. Griffin et al., "Multiband Excitation Vocoder," IEEE Transactions on Acoustics, Speech, and Signal Processing, vol. 36, No. 8, Aug. 1988, pp. 1223–1235.

*Primary Examiner*—Allen R. MacDonald
*Assistant Examiner*—Thomas Onka
*Attorney, Agent, or Firm*—Limbach & Limbach; Ian Hardcastle

[57] ABSTRACT

A compressed digital speech signal is encoded to provide a transmission error-resistant transmission signal. The compressed speech signal is derived from a digital speech signal by performing a pitch search on a block obtained by dividing the speech signal in time to provide pitch information for the block. The block of the speech signal is orthogonally transformed to provide spectral data, which is divided by frequency into plural bands in response to the pitch information. A voiced/unvoiced sound discrimination generates voiced/-unvoiced (V/UV) information indicating whether the spectral data in each of the plural bands represents a voiced or an unvoiced sound. The spectral data in the plural bands are interpolated to provide spectral amplitudes for a predetermined number of bands, independent of the pitch. Hierarchical vector quantizing is applied to the spectral amplitudes to generate upper-layer indices, representing an overview of the spectral amplitudes, and lower-layer indices, representing details of the spectral amplitudes. CRC error detection coding is applied to the upper-layer indices, the pitch information, and the V/UV information to generate CRC codes. Convolution coding for error correction is applied to the upper-layer indices, the higher-order bits of the lower-layer indices, the pitch information, the V/UV information, and the CRC codes. The convolution-coded quantities from two blocks of the speech signal are then interleaved in a frame of the transmission signal, together with the lower-order bits of the respective lower-layer indices.

7 Claims, 15 Drawing Sheets

VOICE ENCODING METHOD AND VOICE DECODING METHOD

BACKGROUND OF THE INVENTION

This invention relates to a method for encoding a compressed speech signal obtained by dividing an input audio signal such as a speech or sound signal into blocks, converting the blocks into data on the frequency axis, and compressing the data to provide a compressed speech signal, and to a method for decoding a compressed speech signal encoded by the speech encoding method.

A variety of compression methods are known for effecting signal compression using the statistical properties of audio signals, including both speech and sound signals, in the time domain and in the frequency domain, and taking account of the characteristics of the human sense of hearing. These compression methods are roughly divided into compression in the time domain, compression in the frequency domain, and analysis-synthesis compression.

In compression methods for speech signals, such as multi-band excitation compression (MBE), single band excitation compression (SBE), harmonic compression, sub-band coding (SBC), linear predictive coding (LPC), discrete cosine transform (DCT), modified DCT (MDCT) or fast Fourier transform (FFT), it has been customary to use scalar quantizing for quantizing the various parameters, such as the spectral amplitude or parameters thereof, such as LSP parameters, $\alpha$ parameters or k parameters.

However, in scalar quantizing, the number of bits allocated for quantizing each harmonic must be reduced if the bit rate is to be lowered to, e.g., approximately 3 to 4 kbps for further improving the compression efficiency. As a result, quantizing noise is increased, making scalar quantizing difficult to implement.

Thus, vector quantizing has been proposed, in which data are grouped into a vector expressed by one code, instead of separately quantizing data on the time axis, data on the frequency axis, or filter coefficient data which are produced as a result of the above-mentioned compression.

However, the size of the codebook of a vector quantizer, and the number of operations required for codebook searching, normally increase in proportion to $2^b$, where b is the number of bits in the output (i.e., the codebook index) generated by the vector quantizing. Quantizing noise is increased if the number of bits b is too small. Therefore, it is desirable to reduce the codebook size and the number of operations for codebook searching while maintaining the number of bits b at a high level. In addition, since direct vector quantizing of the data resulting from converting the signal into data on the frequency axis does not allow the coding efficiency to be increased sufficiently, a technique is needed for further increasing the compression ratio.

Thus, in Japanese Patent Application Serial No. 4-91422, the present Assignee has proposed a high efficiency compression method for reducing the codebook size of the vector quantizer and the number of operations required for codebook searching without lowering the number of output bits of the vector quantizing, and for improving the compression ratio of the vector quantizing. In this high efficiency compression method, a structured codebook is used, and the data of an M-dimensional vector is divided into plural groups to find a central value for each of the groups to reduce the vector from M dimensions to S dimensions (S<M). First vector quantizing of the S-dimensional vector data is performed, an S-dimensional code vector is found, which serves as the local expansion output of the first vector quantizing. The S-dimensional code vector is expanded to a vector of the original M dimensions, and data indicating the relation between the S-dimensional vector expanded to M dimensions and the original M-dimensional vector, and second vector quantizing of the data is performed. This reduces the number of operations required for codebook searching, and requires a smaller memory capacity.

In the above-described high efficiency compression method, error correction is applied to the relatively significant upper-layer codebook index indicating the S-dimensional code vector that provides the local expansion output in the first quantizing. However, no practical method for performing this error correction has been disclosed.

For example, it is conceivable to implement error correction in a compressed signal transmission system in which the encoder is provided with a measure for detecting errors for each compression unit or frame, and is further provided with a convolution encoder as a measure for error correction of the frame, and the decoder detects errors for each frame after implementing error correction utilizing the convolution encoder, and replaces the frame having an error by a preceding frame or mutes the resulting speech signal. However, even if one bit of bits subject to error detection has an error after the error correction, the entire frame containing the erroneous bit is discarded. Therefore, when there are consecutive errors, a discontinuity in the speech signal results, causing a deterioration in perceived quality.

SUMMARY OF THE INVENTION

In view of the above-described state of the art, it is an object of the present invention to provide a speech compression method and a speech expansion method by which it is possible to produce a compressed signal that is strong against errors in the transmission path and high in transmission quality.

According to the present invention, there is provided a speech compression method for dividing, into plural bands, data on the frequency axis produced by dividing input audio signals by a block unit and then converting the signals into those on the frequency axis, and for using multi-band excitation to discriminate voiced/unvoiced sounds from each other for each band, the method including the steps of carrying out hierarchical vector quantizing of a spectrum envelope of amplitude which is the data on the frequency axis, and carrying out error correction compression of index data on an upper layer of output data of the hierarchical vector quantizing by convolution compression.

In the error correction compression, convolution compression may be carried out on upper bits of index data on a lower layer of the output data as well as the index data on the upper layer of the output data of the hierarchical vector quantizing.

Also, in the error correction compression, convolution compression may be carried out on pitch information extracted for each of the blocks and voiced/unvoiced sound discriminating information as well as the index data on the upper layer of the output data of the hierarchical vector quantizing and the upper bits of the index data on the lower layer of the output data.

In addition, the pitch information, the voiced/unvoiced sound discriminating information and the index data on the upper layer of the output data of the hierarchical vector quantizing which have been processed by error detection compression may be processed by convolution compression of the error correction compression together with the upper bits of the index data on the lower layer of the output data of the hierarchical vector quantizing. In this case, CRC error detection compression is preferable as the error detection compression.

Also, in the error correction compression, convolution compression may be carried out on plural frames as a unit processed by the CRC error detection compression.

According to the present invention, there is also provided a speech expansion method for expansion signals having pitch information, voiced/unvoiced sound discriminating information and index data on an upper layer of spectrum envelope hierarchical vector quantizing output data which are processed by CRC error correction compression of a speech compression method using multi-band excitation, and are convolution-encoded along with upper bits of index data on a lower layer of the hierarchical vector quantizing output data, so as to be transmitted, the method including the steps of carrying out CRC error detection of the transmitted signals processed by error correction expansion due to convolution compression, and interpolating data of an error-corrected frame when an error is detected in the CRC error detection.

When errors are not detected in the CRC error detection, the above speech expansion method may include controlling a reproduction method of spectrum envelope on the basis of the dimensional relation of each spectral envelope produced from each data of a preceding frame and a current frame of a predetermined number of frames.

The pitch information, the voiced/unvoiced sound discriminating information and the index data on the upper layer of the hierarchical vector quantizing output data may be processed by CRC error detection expansion, and may be convolution-encoded along with upper bits of index data on a lower layer of the hierarchical vector quantizing output data, thus being strongly protected.

The transmitted pitch information, voiced/unvoiced sounds discriminating information and hierarchical vector quantizing output data are processed by CRC error detection after being processed by error correction expansion, and are interpolated for each frame in accordance with results of the CRC error detection. Thus, it is possible to produce speechs strong as a whole against errors in a transmission path and high in transmission quality.

DESCRIPTION OF THE PREFERRED EMBODIMENT

An embodiment of the compressed speech signal encoding method according to the present invention will now be described with reference to the accompanying drawings.

The compressed speech signal encoding method is applied to an apparatus employing a multi-band excitation (MBE) coding method for converting each block of a speech signal into a signal on the frequency axis, dividing the frequency band of the resulting signal into plural bands, and discriminating voiced (V) and unvoiced (UV) sounds from each other for each of the bands.

That is, in the compressed speech signal encoding method according to the present invention, an input audio signal is divided into blocks each consisting of a predetermined number of samples, e.g., 256 samples, and each resulting block of samples is converted into spectral data on the frequency axis by an orthogonal transform, such as an FFT, and the pitch of the signal in each block of samples is extracted. The spectral data on the frequency axis are divided into plural bands at an interval according to the pitch, and then voiced (V)/unvoiced (UV) sound discrimination is carried out for each of the bands. The V/UV sound discriminating information is encoded for transmission in the compressed speech signal together with spectral amplitude data and pitch information. In the present embodiment, to protect these parameters from the effects of errors in the transmission path when the compressed speech signal is transmitted, the bits of the bit stream consisting of the pitch information, the V/UV discriminating information and the spectral amplitude data are classified according to their importance. The bits that are classified as more important are convolution coded. The particularly significant bits are processed by CRC error-detection coding, which is preferred as the error detection coding.

Figure 1:
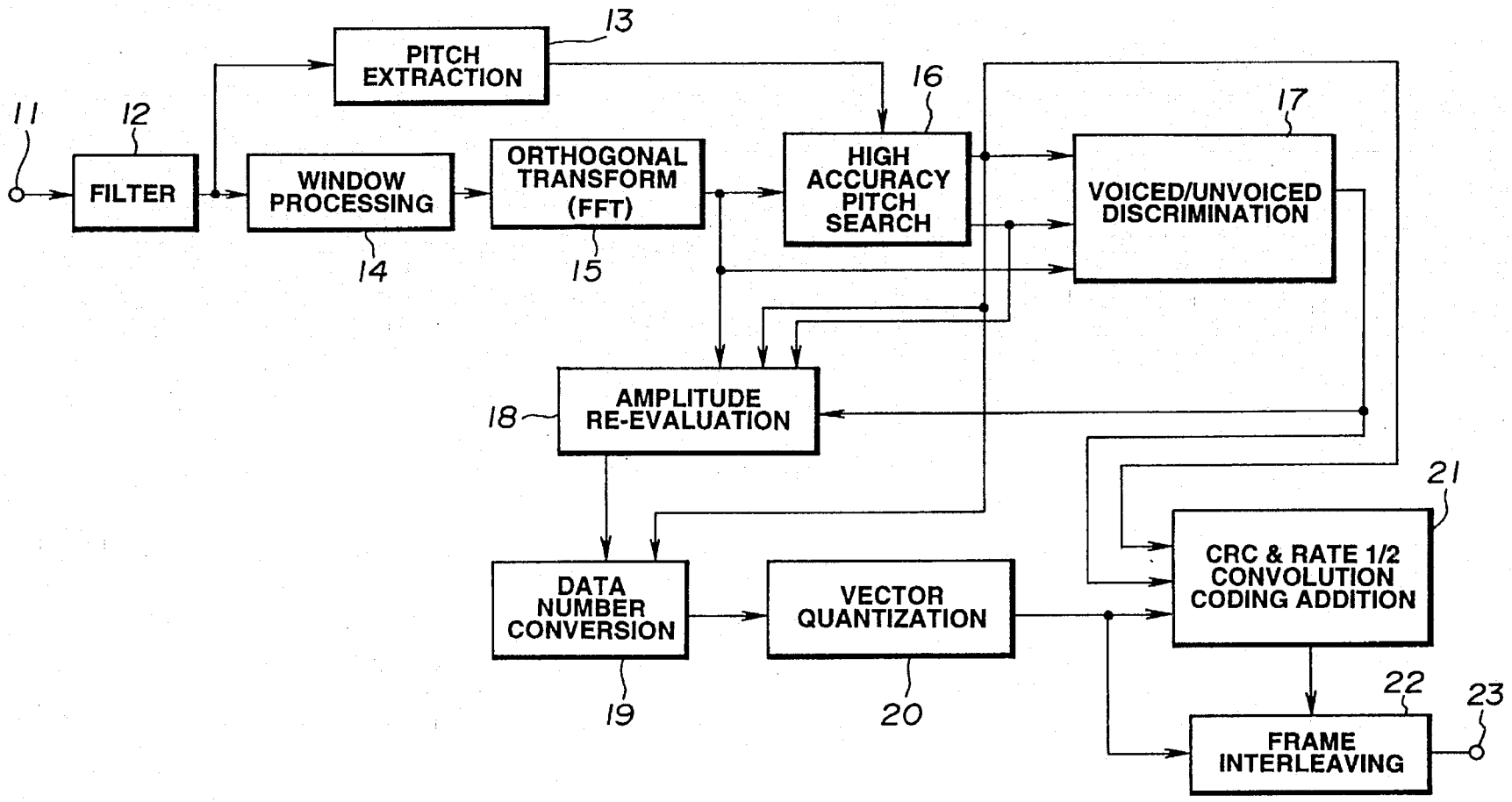
FIG. 1 is a block diagram showing a schematic arrangement on the compression side of an embodiment in which the compressed speech signal encoding method according to the present invention is applied to an MBE vocoder.

FIG. 1 is a block diagram showing the schematic arrangement of the compression side of the embodiment in which the compressed speech signal encoding method according to the present invention is applied to an multi-band excitation (MBE) compression/expansion apparatus (so-called vocoder).

The MBE vocoder is disclosed in D. W. Griffin and J. S. Lim, "*Multiband Excitation Vocoder*," IEEE TRANS. ACOUSTICS, SPEECH, AND SIGNAL PROCESSING, Vol. 36, No. 8, August 1988, pp.1223–1235. In the MBE vocoder, speech is modelled on the assumption that voiced sound zones and unvoiced sound zones coexist in the same block, whereas, in a conventional partial auto-correlation (PARCOR) vocoder, speech is modelled by switching between a voiced sound zone and an unvoiced sound zone for each block or each frame.

Figure 2A:
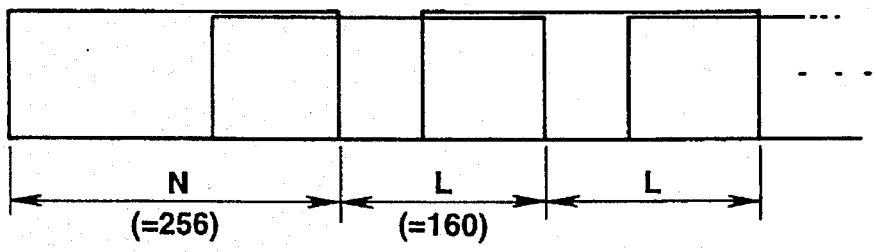
FIGS. 2A and 2B are views for illustrating window multiplication processing.

Referring to FIG. 1, a digital speech signal or a sound signal is supplied to the input terminal 11, and then to the filter 12, which is, for example, a high-pass filter (HPF), where any DC offset and at least the low-frequency components below 200 Hz are removed to limit the bandwidth to, e.g., 200 to 3400 Hz. The signal from the filter 12 is supplied to the pitch extraction section 13 and to the window multiplication processing section 14. In the pitch extraction section 13, the samples of the input speech signal are divided into blocks, each consisting of a predetermined number N of samples, e.g., 256 samples, or are extracted by a rectangular window, and pitch extraction is carried out on the fragment of the speech signal in each block. These blocks, each consisting of, e.g., 256 samples, advance along the time axis at a frame overlap interval of L samples, e.g., 160 samples, as shown in FIG. 2A. This results in an inter-block overlap of (N–L) samples, e.g., 96 samples. In the window multiplication processing section 14, the N samples of each block are multiplied by a predetermined window function, such as a Hamming window. Again, the resulting window-multiplied blocks advance along the time axis at a frame overlap interval of L samples per frame.

The window multiplication processing may be expressed by the following formula:

$$x_w(k,q)=x(q)w(kL-q) \tag{1}$$

where k denotes the block number, and q denotes the time index of the sample number. The formula shows that the qth sample x(q) of the input signal prior to processing is multiplied by the window function of the kth block w(k1–q) to give the result $x_w(k, q)$. In the pitch extraction section 13, the window function $w_r(r)$ of the rectangular window shown in FIG. 2A is:

$$\begin{aligned} w_r(r) &= 1 \quad 0 \leqq r < N \\ &= 0 \quad r < 0, N \leqq r \end{aligned} \tag{2}$$

Figure 2B:
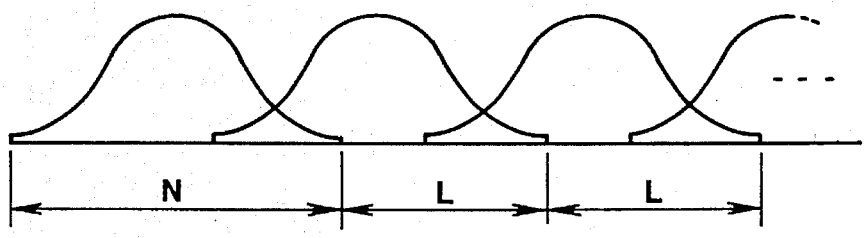

In the window multiplication processing section 14, the window function $w_h(r)$ of the Hamming window shown in FIG. 2B is:

$$\begin{aligned} w_h(r) &= 0.54 - 0.46\cos(2\pi r/(N-1)) \quad 0 \leqq r < N \\ &= 0 \quad r < 0, N \leqq r \end{aligned} \tag{3}$$

If the window function $w_r(r)$ or $w_h(r)$ is used, the non-zero domain of the window function w(r) (=w(k1–q)) is:

$$0 \leqq kL-q < N$$

This may be rewritten as:

$$kL-N < q \leqq kL$$

Figure 3:
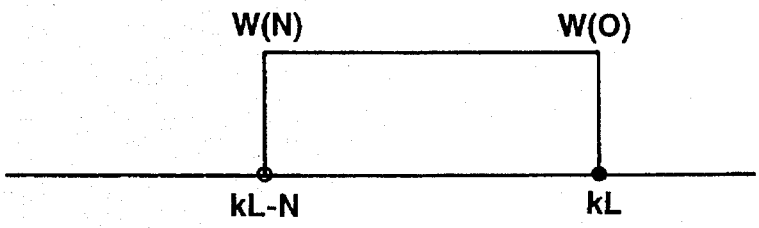
FIG. 3 is a view for illustrating the relation between window multiplication processing and a window function.

Therefore, when kL–N<q≦kL, the window function $w_r(kL-q)=1$ is given when using the rectangular window, as shown in FIG. 3. The above formulas (1) to (3) indicate that the window having a length of N (=256) samples is advanced at a frame overlap interval of L (=160) samples per frame. Non-zero sample trains at each N (0<r<N) points, extracted by each of the window functions of the formulas (2) and (3), are denoted by $x_{wr}(k, r)$ and $x_{wh}(k, r)$, respectively.

Figure 4:
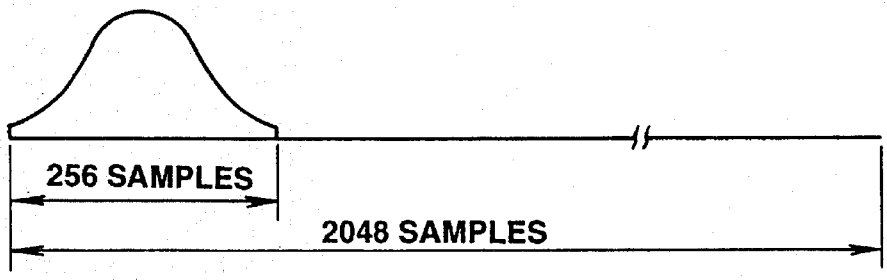
FIG. 4 is a view showing the time-axis data subject to an orthogonal transform (FFT).

In the window multiplication processing section 14, 1792 zero samples are added to the 256-sample sample train $x_{wh}(k, r)$, multiplied by the Hamming window of formula (3), to produce a 2048-sample array on the time axis, as shown in FIG. 4. The sample array is then processed by an orthogonal transform, such as a fast Fourier transform (FFT), in the orthogonal transform section 15.

In the pitch extraction section 103, pitch extraction is carried out on the sample train $x_{wr}(k, r)$ that includes the N-sample block. Pitch extraction may be carried out using the periodicity of the temporal waveform, the periodic spectral frequency structure, or an auto-correlation function. However, the center clip waveform auto-correlation method is adopted in the present embodiment. One clip level may be set as the center clip level for each block. In the present embodiment, however, the peak level of the samples in each of plural sub-blocks in the block is detected. As the difference in the peak level between each sub-block increases, the clip level of the block progressively or continuously changes. The pitch period is determined from the position of peak of the auto-correlated data of the center clip waveform. In determining this pitch period, plural peaks are found from the auto-correlated data of the current frame, where auto-correlation is found using one block of N samples as a target. If the maximum one of these peaks is not less than a predetermined threshold, the position of the maximum peak is the pitch period. Otherwise, a peak is found which is in the pitch range having a predetermined relation to the pitch of a frame other than the current frame, such as the preceding frame or the succeeding frame. For example, the position of the peak that is in the pitch range of ±20% with respect to the pitch of the preceding frame may be found, and the pitch of the current frame determined on the basis of this peak position. The pitch extraction section 13 conducts a relatively rough pitch search using an open-loop method. The resulting pitch data are supplied to the fine pitch search section 16, in which a fine pitch search is carried out using a closed-loop method.

Integer-valued rough pitch data determined by the pitch extraction section 13 and spectral data on the frequency axis resulting from processing by, for example, a FFT in the orthogonal transform section 15 are supplied to the fine pitch search section 16. The fine pitch search section 16 produces an optimum fine pitch value with floating point representation by oscillation of ±several samples at a rate of 0.2 to 0.5 about the pitch value as the center. A synthesis-by-analysis method is employed as the fine search technique for selecting the pitch such that the synthesized power spectrum is closest to the power spectrum of the original sound.

Figure 5A:
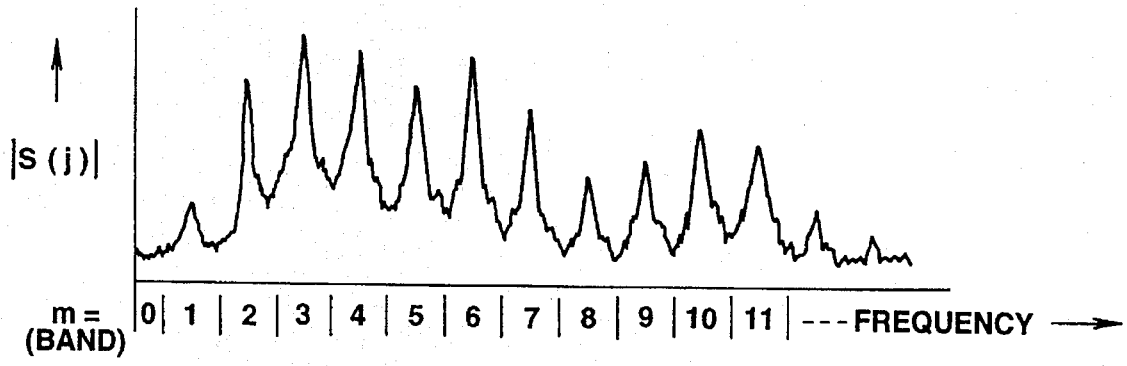
FIGS. 5A–5C are views showing spectral data on the frequency axis, the spectral envelope and the power spectrum of an excitation signal.
Figure 5B:
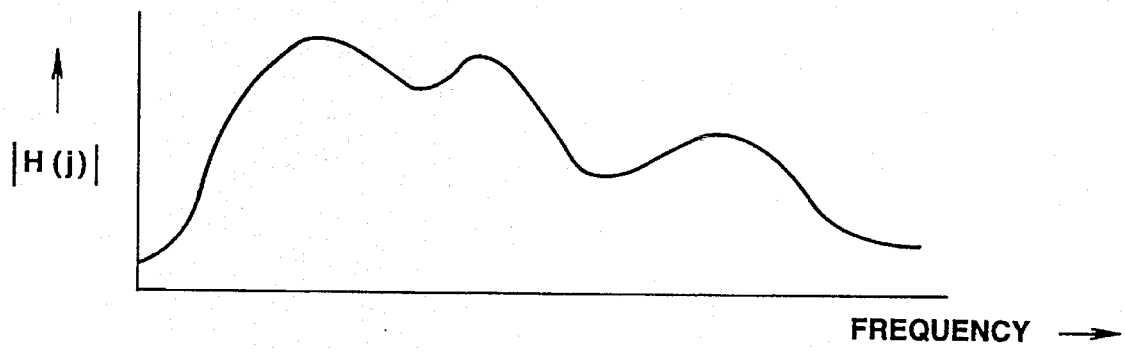
Figure 5C:
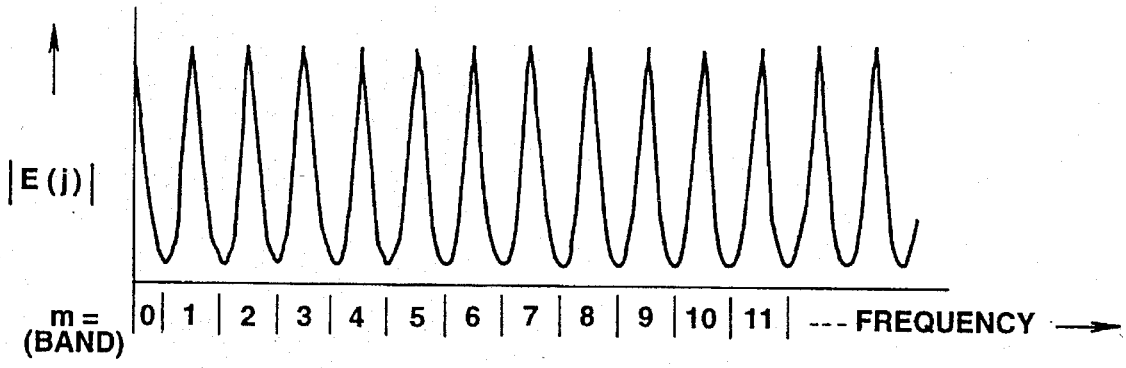

The fine pitch search processing will now be described. In an MBE vocoder, it is assumed that the spectral data S(j) on the frequency axis resulting from processing by, e.g., an FFT are expressed by $$S(j)=H(j)|E(j)|0<j<J \tag{4}$$

where J corresponds to $\omega_s/4\pi=f_s/2$, and to 4 kHz when the sampling frequency $f_s=\omega_s/2\pi$ is 8 kHz. In formula (4), if the spectral data |S(j)| have the waveform the shown in FIG. 5A, H(j) indicates the spectral envelope of the original spectral data S(j), as shown in FIG. 5B, while E(j) indicates the spectrum of the equi-level periodic excitation signal shown in FIG. 5C. That is, the FFT spectrum |S(j)| is the model for the product of the spectral envelope H(j) and the power spectrum |E(j)| of the excitation signal.

The power spectrum |E(j)| of the excitation signal is formed by repetitively arraying the spectral waveform corresponding to a one-band waveform, for each band on the frequency axis, in consideration of periodicity (pitch structure) of the waveform on the frequency axis determined in accordance with the pitch. The one-band waveform may be formed by FFT-processing the waveform consisting of the 256-sample Hamming window function with 1792 zero samples added thereto, as shown in FIG. 4, as the time-axis signal, and by dividing the impulse waveform having bandwidths on the frequency axis in accordance with the above pitch.

Then, for each of the bands divided in accordance with the pitch, an amplitude |Am| which will represent H(j) (or which will minimize the error for each band) is found. If upper and lower limit points of, e.g., the mth band (band of the mth harmonic) are $a_m$ and $b_m$, respectively, the error $\epsilon_m$ of the mth band is expressed by:

$$\epsilon_m=\sum_{j=a_m}^{b_m}[|S(j)|-|A_m||E(j)|]^2 \tag{5}$$

The value of |Am| which will minimize the error $\epsilon_m$ is given by:

$$\frac{\partial\epsilon_m}{\partial|A_m|}=-2\sum_{j=a_m}^{b_m}[|S(j)|-|A_m||E(j)|] \tag{6}$$

$$|A_m|=\sum_{j=a_m}^{b_m}|S(j)||E(j)|/\sum_{j=a_m}^{b_m}|E(j)|^2$$

The value of |Am| given by the above formula (6) minimizes the error $\epsilon_m$.

The amplitude |Am| is found for each band and the error $\epsilon_m$ for each band as defined by the formula (5) is found. The sum $\Sigma\epsilon_m$ of the errors $\epsilon_m$ for the respective bands is found. The sum $\Sigma\epsilon_m$ of all of the bands is found for several minutely-different pitches and the pitch that minimizes the sum $\Sigma\epsilon_m$ of the errors is found.

Several minutely-different pitches above and below the rough pitch found by the pitch extraction section 13 are provided at an interval of, e.g., 0.25. The sum of the errors $\Sigma\epsilon_m$ of all the bands is found for each of the minutely-different pitches. If the pitch is determined, the bandwidth is determined. Using the power spectrum |s(j)| of the spectral data on the frequency axis and the excitation signal spectrum |E(j)|, the error $\epsilon_m$ of formula (5) is found from formula (6) so as to find the sum $\Sigma\epsilon_m$ of all the bands. The sum $\Sigma\epsilon_m$ of errors is found for each pitch, and then a pitch corresponding to the minimum sum of errors is determined as the optimum pitch. Thus, the finest pitch (such as 0.25-interval pitch) is found in the fine pitch search section 16 so as to determine the amplitude |Am| corresponding to the optimum pitch.

To simplify the above explanation of the fine pitch search, it is assumed that all the bands are of voiced sounds. However, since, in the model adopted in the MBE vocoder, an unvoiced zone is present at the concurrent point on the frequency axis, it is necessary to discriminate between the voiced sound and the unvoiced sound for each band.

The fine pitch search section 16 feeds data indicating the optimum pitch and the amplitude |Am| the voiced/unvoiced discriminating section 17, in which an voiced/unvoiced discrimination is made for each band. The discrimination is made using the noise-to-signal ratio (NSR). The NSR for the mth band is given by:

$$NSR=\frac{\sum_{j=a_m}^{b_m}[|S(j)|-|A_m||E(j)|]^2}{\sum_{j=a_m}^{b_m}|S(j)|^2} \tag{7}$$

If the NSR value is larger than a predetermined threshold of, e.g., 0.3, that is, if the error is larger, approximating |S(j)| by |Am||E(j)| for the band is regarded as being improper, the excitation signal |E(j)| is regarded as being inappropriate as the base, and the band is determined to be a UV (unvoiced) band. If otherwise, the approximation is regarded as being acceptable, and the band is determined to be a V (voiced) band.

The amplitude re-evaluation section 18 is supplied with the spectral data on the frequency axis from the orthogonal transform section 15, data of the amplitude |Am| from the fine pitch search section 16, and the V/UV discrimination data from the V/UV discriminating section 17. The amplitude re-evaluation section 18 re-determines the amplitude for the band which has been determined to be an unvoiced (UV) band by the V/UV discriminating section 17. The amplitude $|Am|_{UV}$ for this UV band may be found by:

$$|A_m|_{UV}=\sqrt{\sum_{j=a_m}^{b_m}|S(j)|^2/(b_m-a_m+1)} \tag{8}$$

Data from the amplitude re-evaluation section 18 are supplied to the number-of-data conversion section 19. The number-of-data conversion section 19 provides a constant number of data notwithstanding variations in the number of bands on the frequency axis, and hence in the number of data, especially in the number of spectral amplitude data, in accordance with the pitch. When the effective bandwidth extends up to 3400 kHz, it is divided into between 8 and 63 bands, depending on the pitch, so that the number $m_{MX}+1$ of amplitude data |Am| (including the amplitude of the UV band $|Am|_{UV}$) for the bands changes in the range from 8 to 63. Consequently, the number-of-data conversion section 19 converts the variable number $m_{MX}+1$ of spectral amplitude data into a predetermined number of spectral amplitude data M.

The number-of-data conversion section 19 may expand the number of spectral amplitude data for one effective band on the frequency axis by extending data at both ends in the block, then carrying out filtering processing of the amplitude data by means of a band-limiting FIR filter, and carrying out linear interpolation thereof, to produce a constant number M of spectral amplitude data.

The M spectral amplitude data from the number-of-data conversion section 19 (i.e., the spectral envelope of the amplitudes) are fed to the vector quantizer 20, which carries out vector quantizing.

In the vector quantizer 20, a predetermined number of spectral amplitude data on the frequency axis, herein M, from the number-of-data conversion section 19 are grouped into an M-dimensional vector for vector quantizing. In general, vector quantizing an M-dimensional vector is a process of looking up in a codebook the index of the code vector closest to the input M-dimensional vector in M-dimensional space. The vector quantizer 20 in the compressor has the hierarchical structure shown in FIG. 6 that performs two-layer vector quantizing on the input vector.

Figure 6:
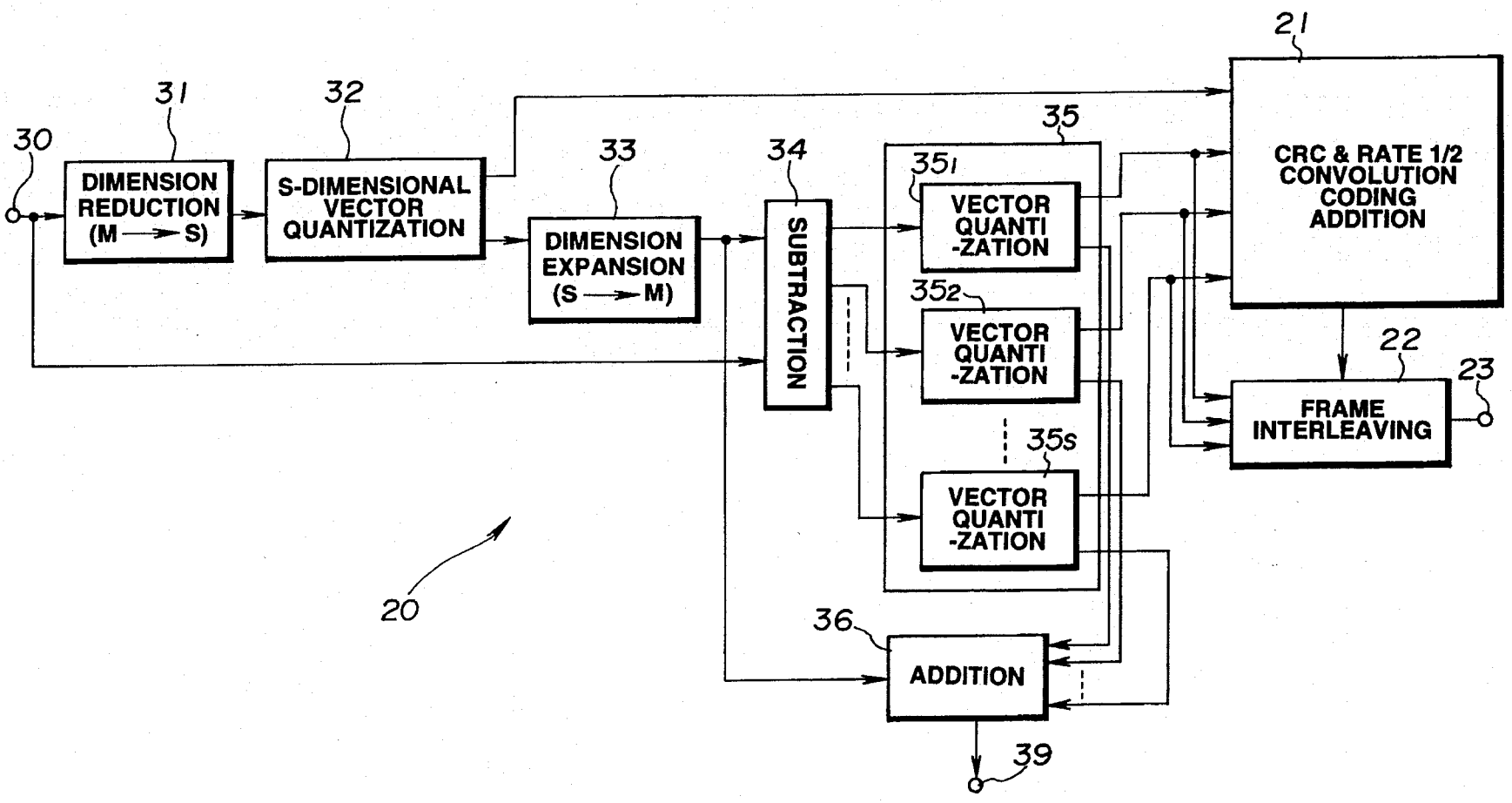
FIG. 6 is a block diagram showing the structure of a hierarchical vector quantizer.
Figure 7:
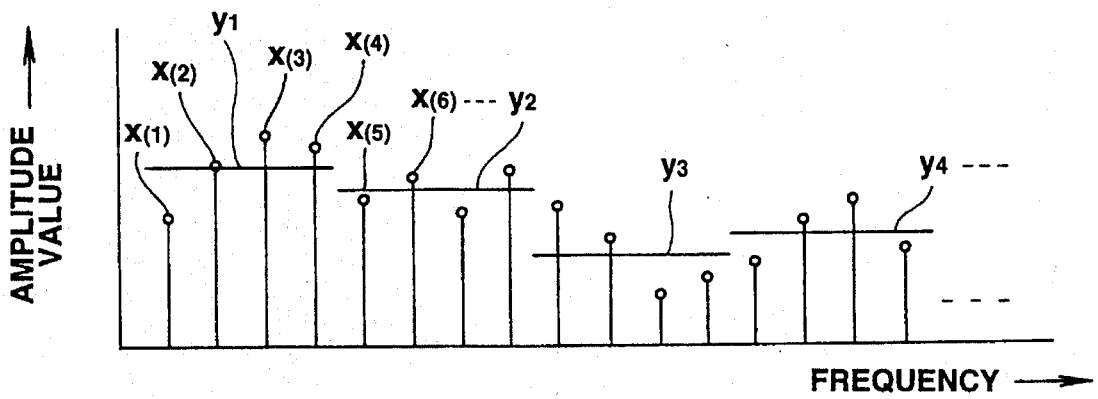
FIG. 7 is a view for illustrating the operation of hierarchical vector quantizing.
Figure 8:
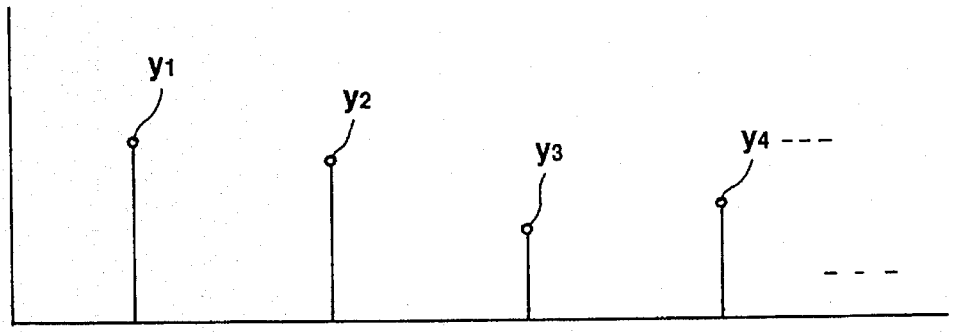
FIG. 8 is a view for illustrating the operation of hierarchical vector quantizing.

In the vector quantizer 20 shown in FIG. 6, the spectral amplitude data to be represented as an M-dimensional vector are supplied as the unit for vector quantizing from the input terminal 30 to the dimension reducing section 21. In the dimension reducing section, the spectral amplitude data are divided into plural groups to find a central value for each group to reduce the number of dimensions from M to S (S<M). FIG. 7 shows a practical example of the processing of the elements of an M-dimensional vector X by the vector quantizer 20, i.e., the processing of M units of spectral amplitude data x(n) on the frequency axis, where $1 \leqq n \leqq M$. These M units of spectral amplitude data x(n) are grouped into groups of, e.g., four units, and a central value, such as the mean value $y_i$, is found for each of these groups of four units. This produces an S-dimensional vector Y consisting of S units of the mean value data $y_1$ to $y_s$, where S=M/4, as shown in FIG. 8.

Figure 9:
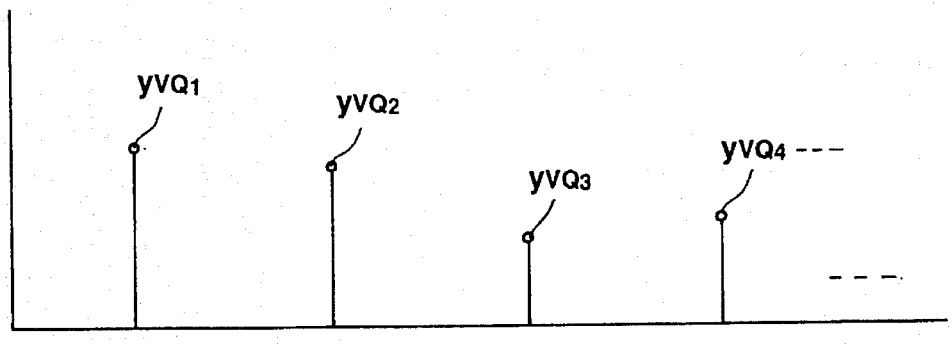
FIG. 9 is a view for illustrating the operation of hierarchical vector quantizing.

The S-dimensional vector Y is vector-quantized by an S-dimensional vector quantizer 32. The S-dimensional vector quantizer 32 searches among the S-dimensional code vectors stored in the codebook therein for the code vector closest to the input S-dimensional vector Y in S-dimensional space. The S-dimensional vector quantizer 32 feeds the codebook index of the code vector found in its codebook to the CRC and rate ½ convolution code adding section 21. Also, the S-dimensional vector quantizer 32 feeds to the dimension expanding section 33 the code vector obtained by inversely vector quantizing the codebook index fed to the CRC and rate ½ convolution code adding section. FIG. 9 shows elements $y_{VQ1}$ to $y_{VQS}$ of the S-dimensional vector $y_{VQ}$ that are the local expander output produced as a result of vector-quantizing the S-dimensional vector Y, which consists of the S units of mean value data $y_1$ to $y_s$ shown in FIG. 8, determining the codebook index of the S-dimensional code vector $Y_{VQ}$ that most closely matches the vector Y, and then inversely quantizing the code vector $Y_{VQ}$ found during quantizing with the codebook of the S-dimensional vector quantizer 32.

Figure 10:
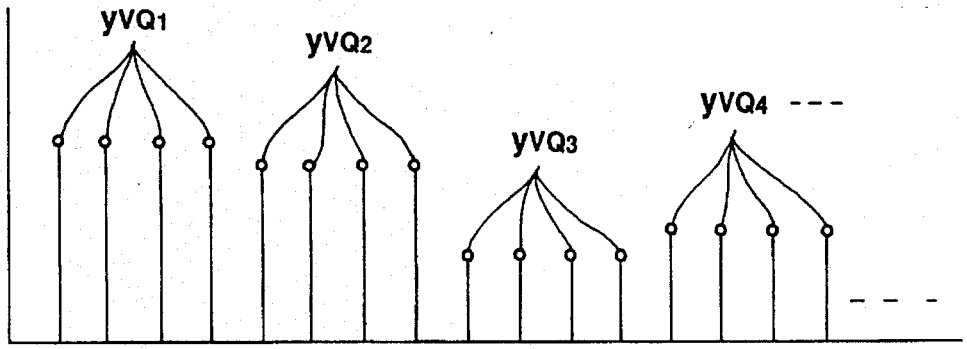
FIG. 10 is a view for illustrating the operation of hierarchical vector quantizing.

The dimension-expanding section 33 expands the above-mentioned S-dimensional code vector $Y_{VQ}$ to a vector in the original M dimensions. FIG. 10 shows an example of the elements of the expanded M-dimensional vector resulting from expanding the S-dimensional vector $Y_{VQ}$. It is apparent from FIG. 10 that the expanded M-dimensional vector consisting of 4S=M elements produced by replicating the elements $y_{VQ1}$ to $y_{VQS}$ of the inverse vector-quantized S-dimensional vector $Y_{VQ}$. Second vector quantizing is then carried out on data indicating the relation between the expanded M-dimensional vector and the spectral amplitude data represented by the original M-dimensional vector.

Figure 11:
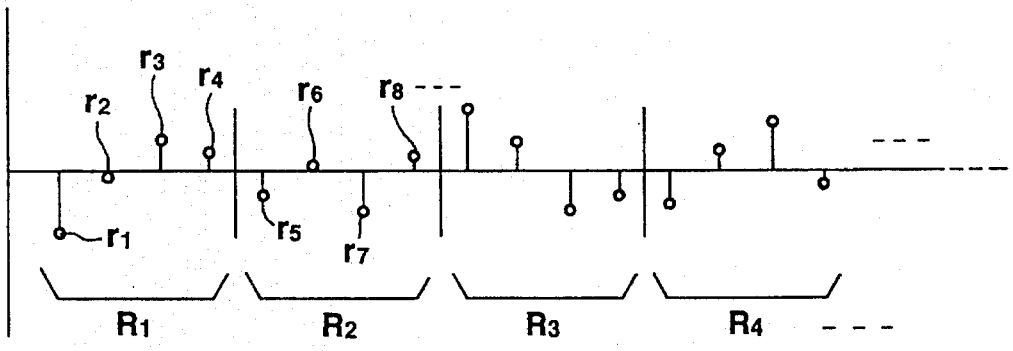
FIG. 11 is a view for illustrating the operation of the hierarchical vector quantizing section.

In FIG. 6, the expanded M-dimensional vector data from the dimension expanding section 33 are fed to the subtractor 34, where it is subtracted from the spectral amplitude data of the original M-dimensional vector, and sets of the resulting differences are grouped to produce S units of vector data indicating the relation between the expanded M-dimensional vector resulting from expanding the S-dimensional code vector $Y_{VQ}$ and the original M-dimensional vector. FIG. 11 shows M units of difference data $r_1$ to $r_M$ produced by subtracting the elements of the expanded M-dimensional vector shown in FIG. 10 from the M units of spectral amplitude data x(n), which are the respective elements of the M-dimensional vector shown in FIG. 7. Four samples each of these M units of difference data $r_1$ to $r_M$ are grouped as sets or vectors, thus producing S units of four-dimensional vectors $R_1$ to $R_S$.

The S units of vector data produced by the subtractor 34 are vector-quantized by the S vector quantizers $\mathbf{35}_1$ to $\mathbf{35}_S$, respectively, of the vector quantizer unit 35. The upper bits of the resulting lower-layer codebook index from each of the vector quantizers $\mathbf{35}_1$ to $\mathbf{35}_S$ are supplied to the CRC and rate ½ convolution code adding section 21, and the remaining lower bits are supplied to the frame interleaving section 22.

Figure 12:
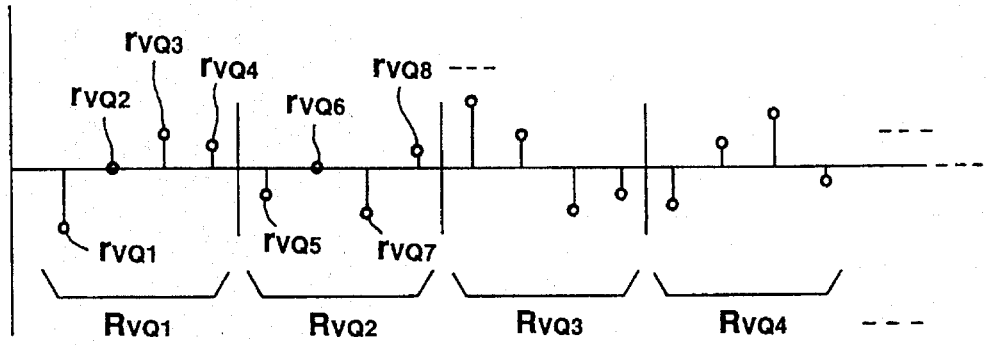
FIG. 12 is a view for illustrating the operation of the hierarchical vector quantizing section.

FIG. 12 shows the elements $r_{VQ1}$ to $r_{VQ4}$, $r_{VQ5}$ to $r_{VQ8}$, . . . $r_{VQM}$ of the respective four-dimensional code vectors $R_{VQ1}$ to $R_{VQS}$ resulting from vector quantizing the four-dimensional vectors $R_1$ to $R_S$ shown in FIG. 11, using four-dimensional vector quantizers as the vector quantizers $\mathbf{35}_1$ to $\mathbf{35}_S$.

As a result of the above-described hierarchical two-stage vector quantizing, it is possible to reduce the number of operations required for codebook searching, and to reduce the amount of memory, such as the ROM capacity, required for the codebook. Also, it is possible to apply error correction codes more effectively by preferentially applying error correction coding to the upper-layer codebook index supplied to the CRC and rate ½ convolution code adding section 21 and the upper bits of the lower-layer codebook indices. The hierarchical structure of the vector quantizer 20 is not limited to two layers, but may alternatively have three or more layers of vector quantizing.

Returning to FIG. 1, the encoding of the compressed signal will now be described. The CRC and rate ½ convolution code adding section 21 is supplied with the fine pitch information from the fine pitch search section 16 and the V/UV discriminating information from the V/UV sound discriminating section 17. The CRC & rate ½ convolution code adding section 21 is additionally supplied with the upper-layer index of the hierarchical vector quantizing output data and the upper bits of the lower-layer indices of the hierarchical vector quantizing output data. The pitch information, the V/UV sound discriminating information and the upper-layer indices of the hierarchical vector quantizing output data are processed by CRC error detection coding and then are convolution-coded. The pitch information, the V/UV sound discriminating information, and the upper-layer codebook index of the hierarchical vector quantizing output data, thus convolution-encoded, and the upper bits of the lower-layer codebook indices of the hierarchical vector quantizing output data are supplied to the frame interleaving section 22, where they are interleaved with the low-order bits of the lower-layer codebook indices of the hierarchical vector quantizing output data. The interleaved data from the interleaving section are fed to the output terminal 23, whence they are transmitted to the expander.

Bit allocation to the pitch information, the V/UV sound discriminating information, and the hierarchical vector quantizing output data, processed by the CRC error detection encoding and the convolution encoding, will now be described with reference to a practical example.

First, 8 bits, for example, are allocated for the pitch information, and 4 bits, for example, are allocated for the V/UV sound discriminating information.

Then, the hierarchical vector quantizing output data representing the spectral amplitude data are divided into the upper and lower layers. This is based on a division into overview information and detailed information of the spectral amplitude data. That is, the upper-layer index of the S-dimensional vector Y vector-quantized by the S-dimensional vector quantizer 32 provides the overview information, and the lower-layer indices from each of the vector quantizers $\mathbf{35}_1$ to $\mathbf{35}_S$ provide the detailed information. The detailed information consists of the vectors $R_{VQ1}$ to $R_{VQS}$ produced by vector-quantizing the vectors $R_1$ to $R_s$ generated by the subtractor 34.

It will now be assumed that M=44, S=7, and that the dimensions of the vectors $R_{VQ1}$ to $R_{VQ7}$ are $d_1=d_2=d_3=d_4=d_5=d_6=d_7=8$. Also, the number of bits used for the spectral amplitude data x(n), in which $1 \leqq n \leqq M$, is set to 48. The bit allocation of the 48 bits is implemented for the S-dimensional vector Y and the output vectors from the vector quantizer unit 35 (i.e., the vectors representing the difference data when the mean values have been subtracted) $R_{VQ1}$, $R_{VQ2}$, ■, $R_{VQ7}$, as follows:

$Y \rightarrow$13 bits(8 bits: shape, 5 bits: gain), dimension $S = 7$
$R_{VQ1} \rightarrow$6 bits, dimension $d_1 = 5$
$R_{VQ2} \rightarrow$5 bits, dimension $d_2 = 5$
$R_{VQ3} \rightarrow$5 bits, dimension $d_3 = 5$
$R_{VQ4} \rightarrow$5 bits, dimension $d_4 = 5$
$R_{VQ5} \rightarrow$5 bits, dimension $d_5 = 8$
$R_{VQ6} \rightarrow$5 bits, dimension $d_6 = 8$
$R_{VQ7} \rightarrow$4 bits, dimension $d_7 = 8$
total 48 bits, ($M$ =) 44 dimensions The S-dimensional vector Y as the overview information is processed by shape-gain vector quantizing. Shape-gain vector quantizing is described in M. J. Sabin and R. M. Gray, *Product Code Vector Quantizer for Waveform and Voice Coding*, IEEE TRANS. ON ASSP, Vol. ASSP-32, No. 3, June 1984.

Thus, a total of 60 bits are to be allocated, consisting of the overview information of the pitch information, the V/UV sound discriminating information, and the spectral envelope, and the vectors representing the differences as the detailed information of the spectral envelope from which the mean values have been removed. Each of the parameters is generated for each frame of 20 msec. (60 bits/20 msec)

Of the 60 bits representing the parameters of the compressed speech signal, the 40 bits that are regarded as being more significant in terms of the human sense of hearing, that is, class-1 bits, are processed by error correction coding using rate ½ convolution coding. The remaining 20 bits, that is, class-2 bits, are not convolution-coded because they are less significant. In addition, the 25 bits of the class-1 bits that are particularly significant to the human sense of hearing are processed by error detection coding using CRC error detection coding. To summarize, the 40 class-1 bits are protected by convolution coding, as described above, while the 20 class-2 bits are not protected. In addition, CRC code is added to the particularly-significant 25 of the 40 class-1 bits.

The addition of the convolution code and the CRC code by the compressed speech signal encoder is conducted according to the following method.

Figure 13:
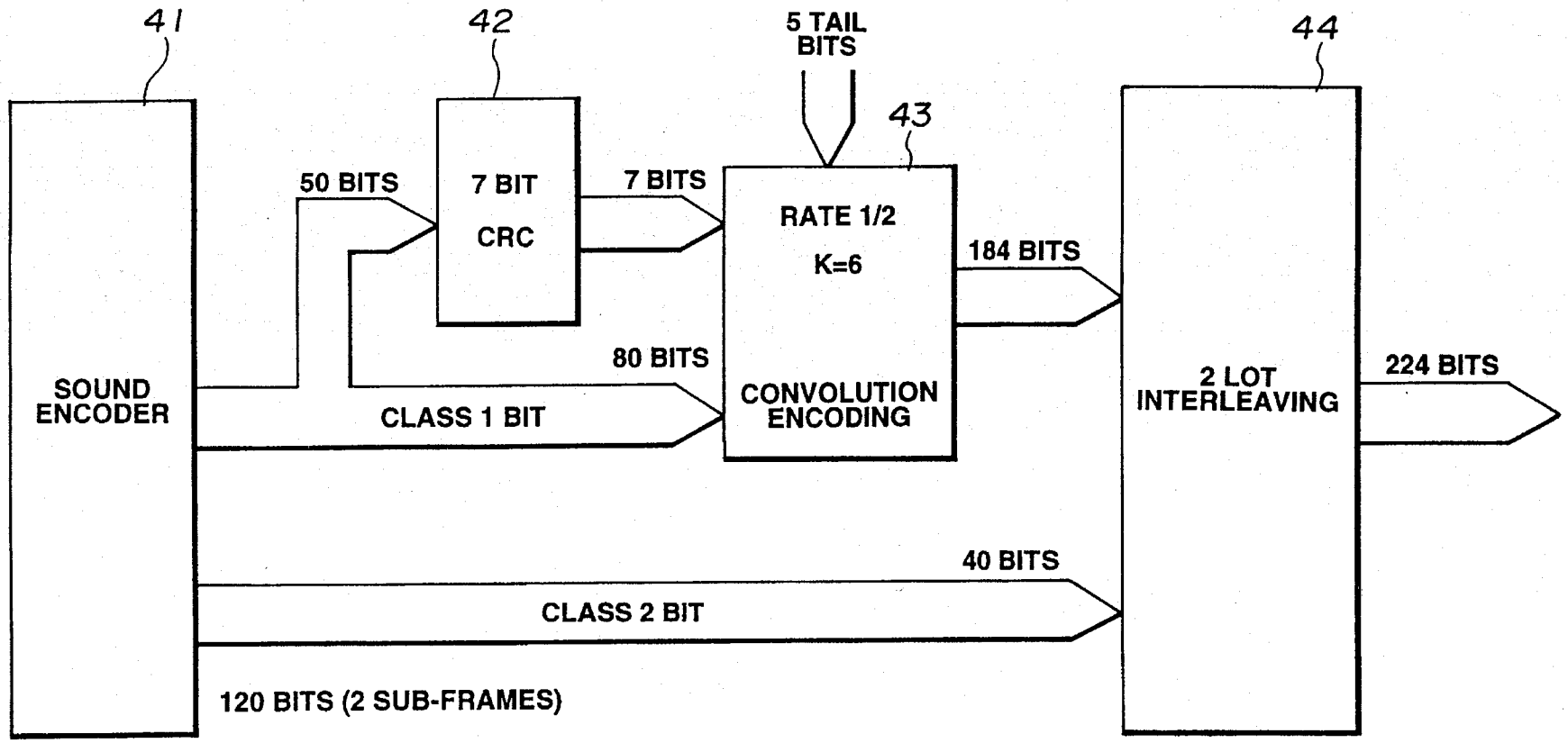
FIG. 13 is a view for illustrating the operation of CRC and convolution coding.

FIG. 13 is a functional block diagram illustrating the method of adding the convolution code and the CRC code. In this, a frame of 40 msec, consisting of two sub-frames of 20 msec each, is used as the unit to which the processing is applied.

Table 1 shows bit allocation for each class of the respective parameter bits of the encoder.

TABLE 1

| Parameter Name | Total Bit Number | CRC Target Bit | Class 1 | Class 2 |
|---|---|---|---|---|
| PITCH | 8 | 8 | 8 | 0 |
| V/UV | 4 | 4 | 4 | 0 |
| Y GAIN | 5 | 5 | 5 | 0 |
| Y SHAPE | 8 | 8 | 8 | 0 |
| $R_{VQ1}$ | 6 | 0 | 3 | 3 |
| $R_{VQ2}$ | 5 | 0 | 3 | 2 |
| $R_{VQ3}$ | 5 | 0 | 2 | 3 |
| $R_{VQ4}$ | 5 | 0 | 2 | 3 |
| $R_{VQ5}$ | 5 | 0 | 2 | 3 |
| $V_{VQ6}$ | 5 | 0 | 2 | 3 |
| $R_{VQ7}$ | 4 | 0 | 1 | 3 |

Also, Tables 2 and 3 show the bit order of the class 1 bits and the bit order of the class 2 bits, respectively.

TABLE 2

| $CL_1[i]$ | Sub-Frame | Name | Index | $CL_1[i]$ | Sub-Frame | Name | Index |
|---|---|---|---|---|---|---|---|
| 0 | — | CRC | 6 | 46 | 0 | $R_{VQ6}$ | 4 |
| 1 | — | CRC | 4 | 47 | 1 | $R_{VQ5}$ | 3 |
| 2 | — | CRC | 2 | 48 | 1 | $R_{VQ5}$ | 4 |
| 3 | — | CRC | 0 | 49 | 0 | $R_{VQ4}$ | 3 |
| 4 | 0 | PITCH | 7 | 50 | 0 | $R_{VQ4}$ | 4 |
| 5 | 1 | PITCH | 6 | 51 | 1 | $R_{VQ3}$ | 3 |
| 6 | 1 | PITCH | 5 | 52 | 1 | $R_{VQ3}$ | 4 |
| 7 | 0 | PITCH | 4 | 53 | 0 | $R_{VQ2}$ | 2 |
| 8 | 0 | PITCH | 3 | 54 | 0 | $R_{VQ2}$ | 3 |
| 9 | 1 | PITCH | 2 | 55 | 1 | $R_{VQ2}$ | 4 |
| 10 | 1 | PITCH | 1 | 56 | 1 | $R_{VQ1}$ | 3 |
| 11 | 0 | PITCH | 0 | 57 | 0 | $R_{VQ1}$ | 4 |
| 12 | 0 | V/UV | 3 | 58 | 0 | $R_{VQ1}$ | 5 |
| 13 | 1 | V/UV | 2 | 59 | 1 | YS | 0 |
| 14 | 1 | V/UV | 1 | 60 | 1 | YS | 1 |
| 15 | 0 | V/UV | 0 | 61 | 0 | YS | 2 |
| 16 | 0 | YG | 4 | 62 | 0 | YS | 3 |
| 17 | 1 | YG | 3 | 63 | 1 | YS | 4 |
| 18 | 1 | YG | 2 | 64 | 1 | YS | 5 |
| 19 | 0 | YG | 1 | 65 | 0 | YS | 6 |
| 20 | 0 | YG | 0 | 66 | 0 | YS | 7 |
| 21 | 1 | YS | 7 | 67 | 1 | YG | 0 |
| 22 | 1 | YS | 6 | 68 | 1 | YG | 1 |
| 23 | 1 | YS | 5 | 69 | 0 | YG | 2 |
| 24 | 0 | YS | 4 | 70 | 0 | YG | 3 |
| 25 | 1 | YS | 3 | 71 | 1 | YG | 4 |
| 26 | 1 | YS | 2 | 72 | 1 | V/UV | 0 |
| 27 | 0 | YS | 1 | 73 | 0 | V/UV | 1 |
| 28 | 0 | YS | 0 | 74 | 0 | V/UV | 2 |
| 29 | 1 | $R_{VQ1}$ | 5 | 75 | 1 | V/UV | 3 |
| 30 | 1 | $R_{VQ1}$ | 4 | 76 | 1 | PITCH | 0 |
| 31 | 0 | $R_{VQ1}$ | 3 | 77 | 0 | PITCH | 1 |
| 32 | 0 | $R_{VQ2}$ | 4 | 78 | 0 | PITCH | 2 |
| 33 | 1 | $R_{VQ2}$ | 3 | 79 | 1 | PITCH | 3 |
| 34 | 1 | $R_{VQ2}$ | 2 | 80 | 1 | PITCH | 4 |
| 35 | 0 | $R_{VQ3}$ | 4 | 81 | 0 | PITCH | 5 |
| 36 | 0 | $R_{VQ3}$ | 3 | 82 | 0 | PITCH | 6 |
| 37 | 1 | $R_{VQ4}$ | 4 | 83 | 1 | PITCH | 7 |
| 38 | 1 | $R_{VQ4}$ | 3 | 84 | — | CRC | 1 |
| 39 | 0 | $R_{VQ5}$ | 4 | 85 | — | CRC | 4 |
| 40 | 0 | $R_{VQ5}$ | 3 | 86 | — | CRC | 5 |
| 41 | 1 | $R_{VQ6}$ | 4 | 87 | — | TAIL | 0 |
| 42 | 1 | $R_{VQ6}$ | 3 | 88 | — | TAIL | 1 |
| 43 | 0 | $R_{VQ7}$ | 3 | 89 | — | TAIL | 2 |
| 44 | 1 | $R_{VQ7}$ | 3 | 90 | — | TAIL | 3 |
| 45 | 0 | $R_{VQ6}$ | 3 | 91 | — | TAIL | 4 |

YG and YS are abbreviations for Y gain and Y shape, respectively.

TABLE 3

| $CL_2[i]$ | Sub-Frame | Name | Index | $CL_2[i]$ | Sub-Frame | Name | Index |
|---|---|---|---|---|---|---|---|
| 0 | 0 | $R_{VQ1}$ | 2 | 20 | 0 | $R_{VQ7}$ | 0 |
| 1 | 1 | $R_{VQ1}$ | 1 | 21 | 1 | $R_{VQ7}$ | 1 |
| 2 | 1 | $R_{VQ1}$ | 0 | 22 | 1 | $R_{VQ7}$ | 2 |
| 3 | 0 | $R_{VQ2}$ | 1 | 23 | 0 | $R_{VQ6}$ | 0 |
| 4 | 0 | $R_{VQ2}$ | 0 | 24 | 0 | $R_{VQ6}$ | 1 |
| 5 | 1 | $R_{VQ3}$ | 2 | 25 | 1 | $R_{VQ6}$ | 2 |
| 6 | 1 | $R_{VQ3}$ | 1 | 26 | 1 | $R_{VQ5}$ | 0 |
| 7 | 0 | $R_{VQ3}$ | 0 | 27 | 0 | $R_{VQ5}$ | 1 |
| 8 | 0 | $R_{VQ4}$ | 2 | 28 | 0 | $R_{VQ5}$ | 2 |
| 9 | 1 | $R_{VQ4}$ | 1 | 29 | 1 | $R_{VQ4}$ | 0 |
| 10 | 1 | $R_{VQ4}$ | 0 | 30 | 1 | $R_{VQ4}$ | 1 |
| 11 | 0 | $R_{VQ5}$ | 2 | 31 | 0 | $R_{VQ4}$ | 2 |
| 12 | 0 | $R_{VQ5}$ | 1 | 32 | 0 | $R_{VQ3}$ | 0 |
| 13 | 1 | $R_{VQ5}$ | 0 | 33 | 1 | $R_{VQ3}$ | 1 |
| 14 | 1 | $R_{VQ6}$ | 2 | 34 | 1 | $R_{VQ3}$ | 2 |
| 15 | 0 | $R_{VQ6}$ | 1 | 35 | 0 | $R_{VQ2}$ | 0 |
| 16 | 0 | $R_{VQ6}$ | 0 | 36 | 0 | $R_{VQ2}$ | 1 |
| 17 | 1 | $R_{VQ7}$ | 2 | 37 | 1 | $R_{VQ1}$ | 0 |
| 18 | 1 | $R_{VQ7}$ | 1 | 38 | 1 | $R_{VQ1}$ | 1 |
| 19 | 0 | $R_{VQ7}$ | 0 | 39 | 0 | $R_{VQ1}$ | 2 |

The class-1 array in Table 2 is denoted by $CL_1[i]$, in which the element number i=0 to 91, and the class-2 array in Table 3 is denoted by $CL_2[i]$, in which i=0 to 39. The first columns of Tables 2 and 3 indicate the element number i of the input array $CL_1[i]$ and the input array $CL_2[i]$, respectively. The second columns of Tables 2 and 3 indicate the sub-frame number of the parameter. The third columns indicate the name of the parameter, while the fourth columns indicate the bit position within the parameter, with 0 indicating the least significant bit.

The 120 bits (60×2 sub-frames) of speech parameters from the speech compressor 41 (FIG. 13) are divided into 80 class-1 bits (40×2 sub-frames) which are more significant in terms of the human sense of hearing, and into the remaining 40 class-2 bits (20×2 sub-frames).

Then, the 50 bits class-1 bits that are particularly significant in terms of the human sense of hearing are divided out of the class-1 bits, and are fed in the CRC calculation block 42, which generates 7 bits of CRC code. The following code generating function $g_{crc}(X)$ is used to generate the CRC code:

$$g_{crc}(X)=1+X^4+X^5+X^6+X^7 \tag{9}$$

If the input bit array to the convolution encoder 43 is denoted by $CL_1[i]$, in which i=0 to 91, as shown in Table 2, the following input function a(X) is employed:

$$a(X) = CL_1[83]X^{49}+CL_1[4]X^{48}+CL_1[82]X^{47}\ldots \tag{10}$$
$$\ldots CL_1[27]X^2+CL_1[59]X^1+CL_1[28]X^0$$

The parity function is the remainder of the input function, and is found as follows:

$$a(X)\cdot X^7/g_{crc}(X)=q(x)+b(x)/g_{crc}(X) \tag{11}$$

If the parity bit b(x) found from the above formula (11) is incorporated in the array $CL_1[i]$, the following is found:

$$b(X)=CL_1[0]X^6+CL_1[86]X^5+CL_1[1]X^4+CL_1 85]X3+CL_1[2]X^2+CL_1[84]X^1+CL_1[3]X^0 \tag{12}$$

Then, the 80 class-1 bits and the 7 bits that result from the CRC calculation by the CRC calculation block 42 are fed into the convolution coder 43 in the input order shown in Table 2, and are processed by convolution coding of rate ½, constraint length 6 (=k). The following two generating functions are used:

$$g_0(D)=1+D+D^3+D^5 \tag{13}$$

$$g_1(D)=1+D^2+D^3+D^4+D^5 \tag{14}$$

Of the input bits shown in Table 2 fed into the convolution encoder 43, 80 bits $CL_1[4]$ to $CL_1[83]$ are class-1 bits, while the seven bits $CL_1[0]$ to $CL_{1\ [3]}$ and $CL_1[84]$ to $CL_1[86]$ are CRC bits. In addition, the five bits $CL_1[87]$ to $CL_1[91]$ are tail bits all having the value of 0 for returning the encoder to its initial state.

Figure 14:
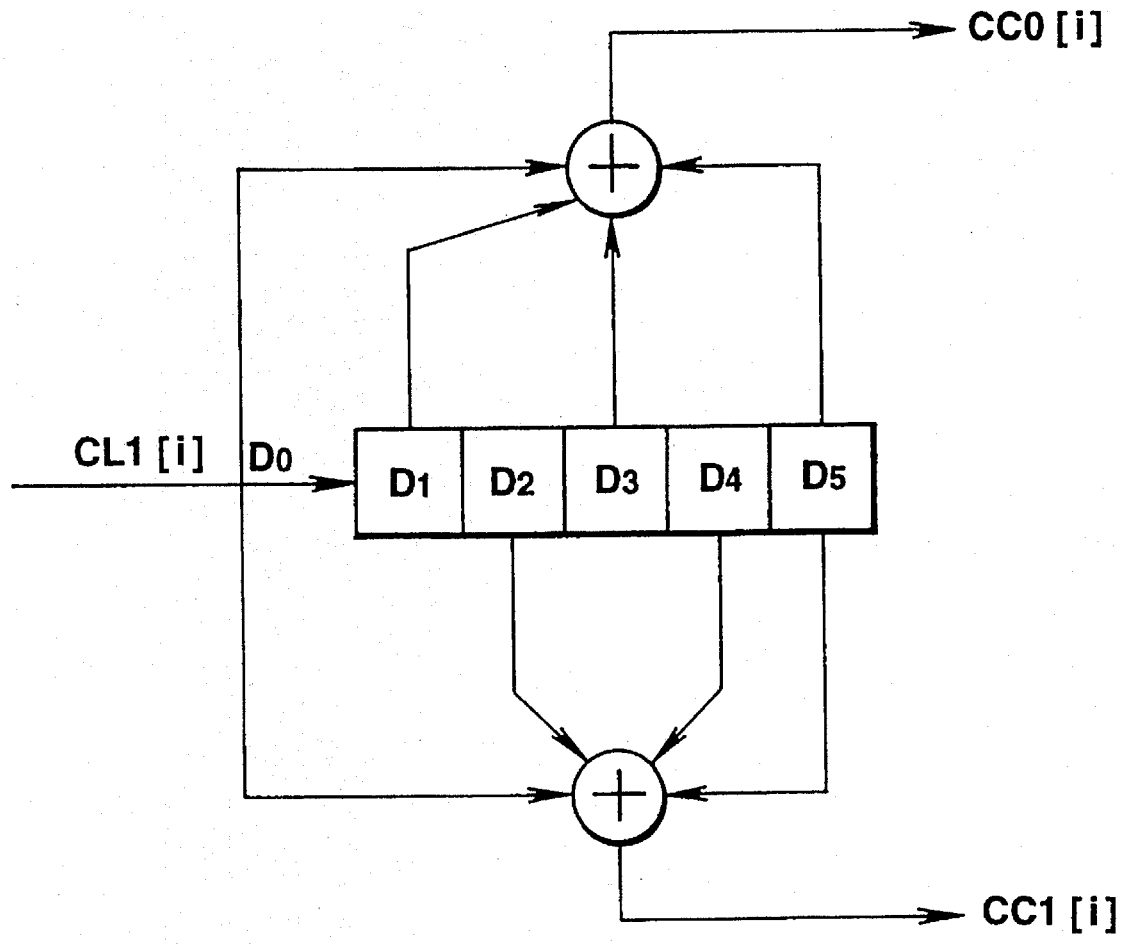
FIG. 14 is view showing the arrangement of a convolution encoder.

The convolution coding starts at $g_0(D)$, and coding is carried out by alternately applying the formulas (13) and (14). The convolution coder 43 includes a 5-stage shift register as a delay element, as shown in FIG. 14, and produces an output by calculating the exclusive OR of the bits corresponding to the coefficient of the generating function. The convolution coder generates an output of two bits $cc_0[i]$ and $cc_1[i]$ from each bit of the input $CL_1[i]$, and therefore generates 184 bits as a result of coding all 92 class-1 bits.

A total of 224 bits, consisting of the 184 convolution-coded class-1 bits and the 40 class-2 bits, are fed to the 2-lot interleaver 44, which performs bit interleaving and frame interleaving across two frames and feeds the resulting interleaved signal in a predetermined order for transmission to the expander.

Each of the speech parameters may be produced by processing data within a block of N samples, e.g., 256 samples. However, since the block advances along the time axis at a frame overlap interval of L samples per frame, the data to be transmitted is produced in units of one frame. That is, the pitch information, the V/UV sound discriminating information, and the spectral amplitude data are updated at intervals of one frame.

The schematic arrangement of the complementary expander for expanding the compressed speech signal transmitted by the compressor just described will now be described with reference to FIG. 15.

Figure 15:
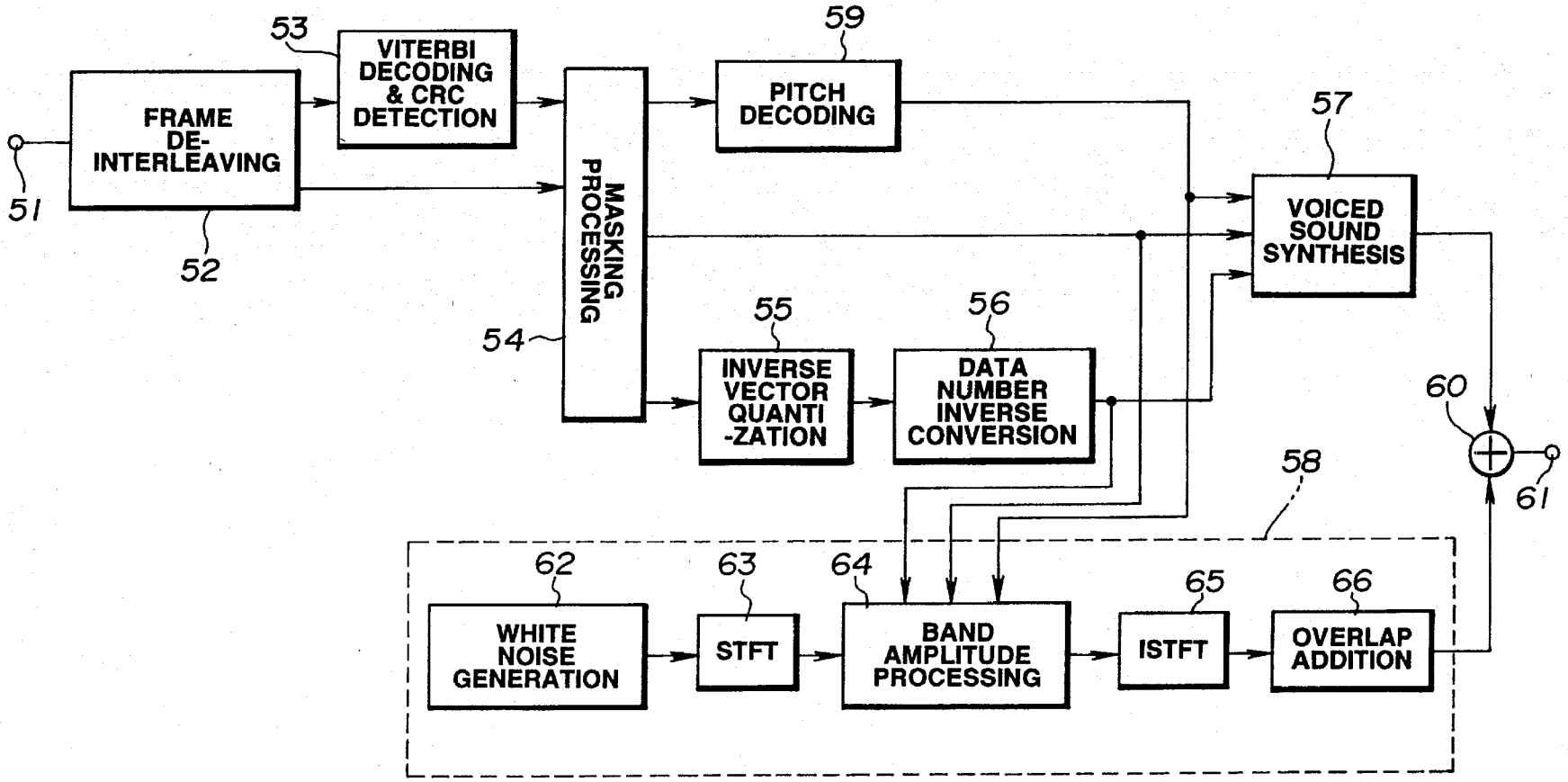
FIG. 15 is a block diagram showing the schematic arrangement of the expansion side of an embodiment in which the compressed speech signal decoding method according to the present invention is applied to an MBE vocoder.

Referring to FIG. 15, the input terminal 51 is supplied with the compressed speech signal received from the compressor. The compressed signal includes the CRC & rate ½ convolution codes. The compressed signal from the input terminal 51 is supplied to the frame de-interleaving section 52, where it is de-interleaved. The de-interleaved signal is supplied to the Viterbi decoder and CRC detecting section 53, where it is decoded using Viterbi decoding and CRC error detection.

The masking processing section 54 masks the signal from the frame de-interleaving section 52, and supplies the quantized spectral amplitude data to the inverse vector quantizer 55.

The inverse vector quantizer 55 is also hierarchically structured, and synthesizes inversely vector-quantized data from the codebook indices of each layer. The output data from the inverse vector quantizer 55 are transmitted to a number-of-data inverse conversion section 56, where the number of data are inversely converted. The number-of-data inverse conversion section 56 carries out inverse conversion in a manner complementary to that performed by the number-of-data conversion section 19 shown in FIG. 1, and transmits the resulting spectral amplitude data to the voiced sound synthesizer 57 and the unvoiced sound synthesizer 58. The above-mentioned masking processing section 54 supplies the coded pitch data to the pitch decoding section 59. The pitch data decoded by the pitch decoding section 59 are fed to the number-of-data inverse conversion section 56, the voiced sound synthesizer 57 and the unvoiced sound synthesizer 58. The masking processing section 54 also supplies the V/UV discrimination data to the voiced sound synthesizer 57 and the unvoiced sound synthesizer 58.

The voiced sound synthesizer 57 synthesizes a voiced sound waveform on the time axis by, for example, cosine wave synthesis, and the unvoiced sound synthesizer 58 synthesizes an unvoiced sound waveform on the time axis by, for example, filtering white noise using a band-pass filter. The voiced sound synthesis waveform and the unvoiced sound synthesis waveform are added and synthesized by the adder 60, and the resulting speech signal is fed to the output terminal 61. In this example, the spectral amplitude data, the pitch data, and the V/UV discrimination data are updated every frame of L samples, e.g., 160 samples, processed by the compressor. To increase or smooth inter-frame continuity, the value of the spectral amplitude data or the pitch data is set at the value at the center of each frame, and the value at the center of the next frame. In other words, in the expander, the values corresponding to each frame in the compressor are determined by interpolation. In one frame in the expander, (taken, for example, from the center of the frame in the compressor to the center of the next frame in the compressor), the data value at the beginning sample point and the data value at the end sample point of the frame (which is also the beginning of the next frame in the compressor) are provided, and the data values between these sample points are found by interpolation.

The synthesis processing in the voiced sound synthesizer 57 will now be described in detail.

The voiced sound $V_m(n)$ for one frame of L samples in the compressor, for example 160 samples, on the time axis in the mth band (the mth harmonic band) determined as a V band can be expressed as follows using the time index (sample number) n within the frame:

$$V_m(n)=A_m(n)\cos(\theta_m(n))\quad 0\leqq n<L \tag{15}$$

The voiced sounds of all the bands determined as V bands are added ($\Sigma V_m(n)$), thereby synthesizing the ultimate voiced sound V(n).

In formula (15), $A_m(n)$ indicates the amplitude of the mth harmonic interpolated between the beginning and the end of the frame in the compressor. Most simply, the value of the mth harmonic of the spectral amplitude data updated every frame may be linearly interpolated. That is, if the amplitude value of the mth harmonic at the beginning of the frame, where n=0, is denoted by $A_{0m}$, and the amplitude value of the mth harmonic at the end of the frame, where n=L, and which corresponds to the beginning of the next frame, is denoted by $A_{Lm}$, $A_m(n)$ may be calculated by the following formula:

$$A_m(n)=(L-n)A_{0m}/L+nA_{Lm}/L \tag{16}$$

Then, the phase $\theta_m(n)$ in formula (16) can be found by the following formula:

$$\theta m(n)=m\omega_{01}n+n^2m(\omega_{L1}-\omega_{01})2L+\phi_{0m}+\Delta\omega n \tag{17}$$

where $\phi_{0m}$ denotes the phase of the mth harmonic at the beginning (n=0) of the frame (frame initial phase), $\omega_{01}$ the fundamental angular frequency at the beginning (n=0) of the frame, and $\omega_{L1}$ the fundamental angular frequency at the end of the frame (n=L, which coincides with the beginning tip of the next frame). The $\Delta\omega$ in formula (17) is set to a minimum so that when n=L, the phase $\phi_{Lm}$ equals $\theta_m(L)$.

The method for finding the amplitude $A_m(n)$ and the phase $\theta_m(n)$ corresponding to the V/UV discriminating results when n=0 and n=L, respectively, in an arbitrary mth band will now be explained.

If the mth band is a V band when both n=0 and n=L, the amplitude $A_m(n)$ may be calculated using linear interpolation of the transmitted amplitudes $A_{0m}$ and $A_{Lm}$ using formula (10). For the phase $\theta_m(n)$, $\Delta\omega$ is set so that $\theta_m(0)=\phi_{0m}$ when n=0, and $\theta_m(L)=\phi_{Lm}$ when n=L.

If the mth band is a V band when n=0 and is an UV band when n=L, the amplitude $A_m(n)$ is found through linear interpolation so that it is 0 from the amplitude $A_{0m}$ of $A_m(0)$ to $A_m(L)$. The amplitude $A_{Lm}$ at n=L is the amplitude value of the unvoiced sound which is employed in the unvoiced sound synthesis that will be described below. The phase $\theta_m(n)$ is so set that $\theta_m(0)=\phi_{0m}$, and that $\Delta\omega=0$.

If the mth band is a UV band when n=0 and is a V band when n=L, the amplitude $A_m(n)$ is linearly interpolated so that the amplitude $A_m(0)$ at n=0 is 0, and the amplitude is the amplitude $A_{Lm}$ at n=L. For the phase $\theta_m(n)$, the phase $\theta_m(0)$ at n=0 is set by the phase value $\phi_{Lm}$ at the end of the frame, so that $$\theta_m(0)=\phi_{Lm}-m(\omega_{01}+\omega_{L1})L/2 \tag{18}$$

and $\Delta\omega=0$.

The technique of setting $\Delta\omega$ so that $\theta_m(L)=\phi_{Lm}$ when the mth band is a V band both when n=0 and when n=L will now be described. In formula (17), setting n=L produces:

$$\begin{aligned}\phi_m(L) &= m\omega_{01}L+L^2m(\omega_{L1}-\omega_{01})/2L+\phi_{0m}+\Delta\omega L\\ &= m(\omega_{01}+\omega_{L1})L/2+\phi_{0m}+\Delta\omega L\\ &= \phi_{Lm}\end{aligned}$$

By modifying the above, $\Delta\omega$ is found as follows:

$$\Delta\omega=(mod2\pi((\phi_{Lm}-\phi_{0m})-mL(\omega_{01}+\omega_{L1})/2))/L \tag{19}$$

In formula (19), mod2π(x) denotes a function returning the main value x between −π and +π. For example, mod2π(x)=−0.7π when x=1.3π; mod2π(x)=0.3π when x=2.3π; and mod2π(x)=0.7π when x=−1.3π.

Figure 16A:
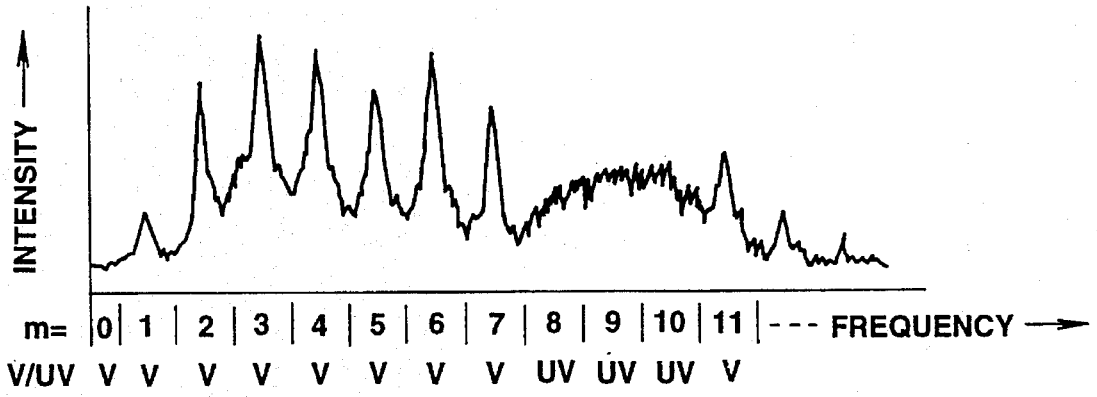
FIGS. 16A–16C are views for illustrating unvoiced sound synthesis in synthesizing speech signals.

FIG. 16A shows an example of the spectrum of a speech signal in which bands having the band number (harmonic number) m of 8, 9, 10 are UV bands while the other bands are V bands. The time-axis signals of the V bands are synthesized by the voiced sound synthesizer 57, while the time axis signals of the UV bands are synthesized by the unvoiced sound synthesizer 58.

The unvoiced sound synthesis processing by the unvoiced sound synthesizer 58 will now be described.

Figure 16B:
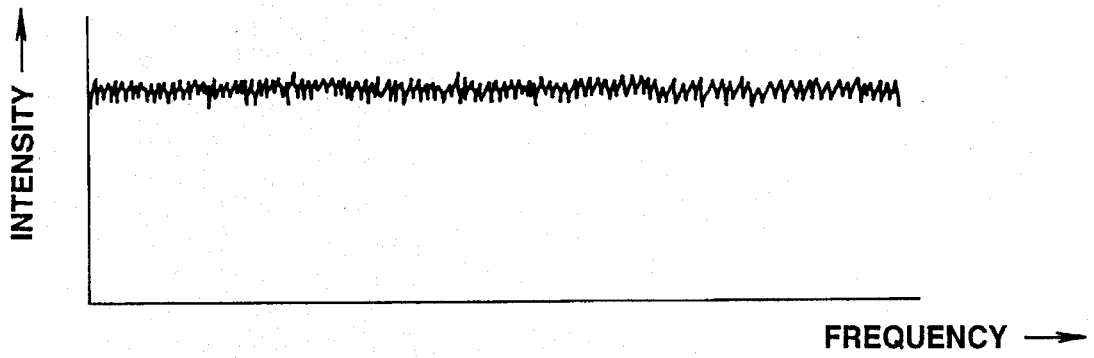
Figure 16C:
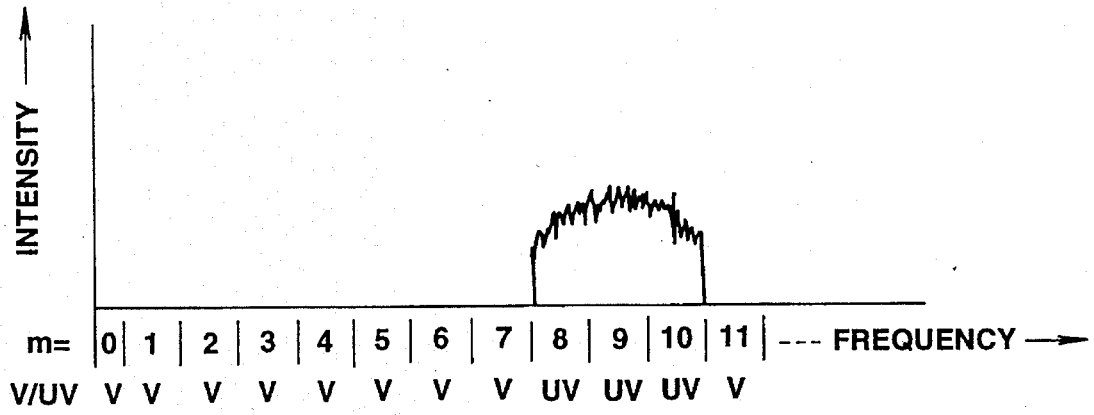

A white noise signal waveform on the time axis from a white noise generator 62 is multiplied by an appropriate window function, for example a Hamming window, of a predetermined length, for example 256 samples, and is processed by a short-term Fourier transform (STFT) by an STFT processing section 63. This results in the power spectrum on the frequency axis of the white noise, as shown in FIG. 16B. The power spectrum from the STFT processing section 63 is fed to a band amplitude processing section 64, where it is multiplied by the amplitudes $|A_m|_{UV}$ of the bands determined as being UV bands, such as those having band numbers m=8, 9, 10, whereas the amplitudes of the other bands determined as being V bands are set to 0, as shown in FIG. 16C. The band amplitude processing section 64 is supplied with the spectral amplitude data, the pitch data and the V/UV discrimination data. The output of the band amplitude processing section 64 is fed to the ISTFT processing section 65, where inverse STFT processing is implemented using the original phase of the white noise. This converts the signal received from the band amplitude processing section into a signal on the time axis. The output from the ISTFT processing section 65 is fed to the overlap adder 66, where overlapping and addition are repeated, together with appropriate weighting on the time axis, to restore the original continuous noise waveform and thereby to synthesize a continuous time-axis waveform. The output signal from the overlap adder 66 is transmitted to the adder 60.

The signals of the voiced sound section and of the unvoiced sound section, respectively synthesized by the synthesizers 57 and 58 and returned to the time axis, are added in an appropriate fixed mixing ratio by the adder 60, and the resulting reproduced speech signal is fed to the output terminal 61.

Figure 17:
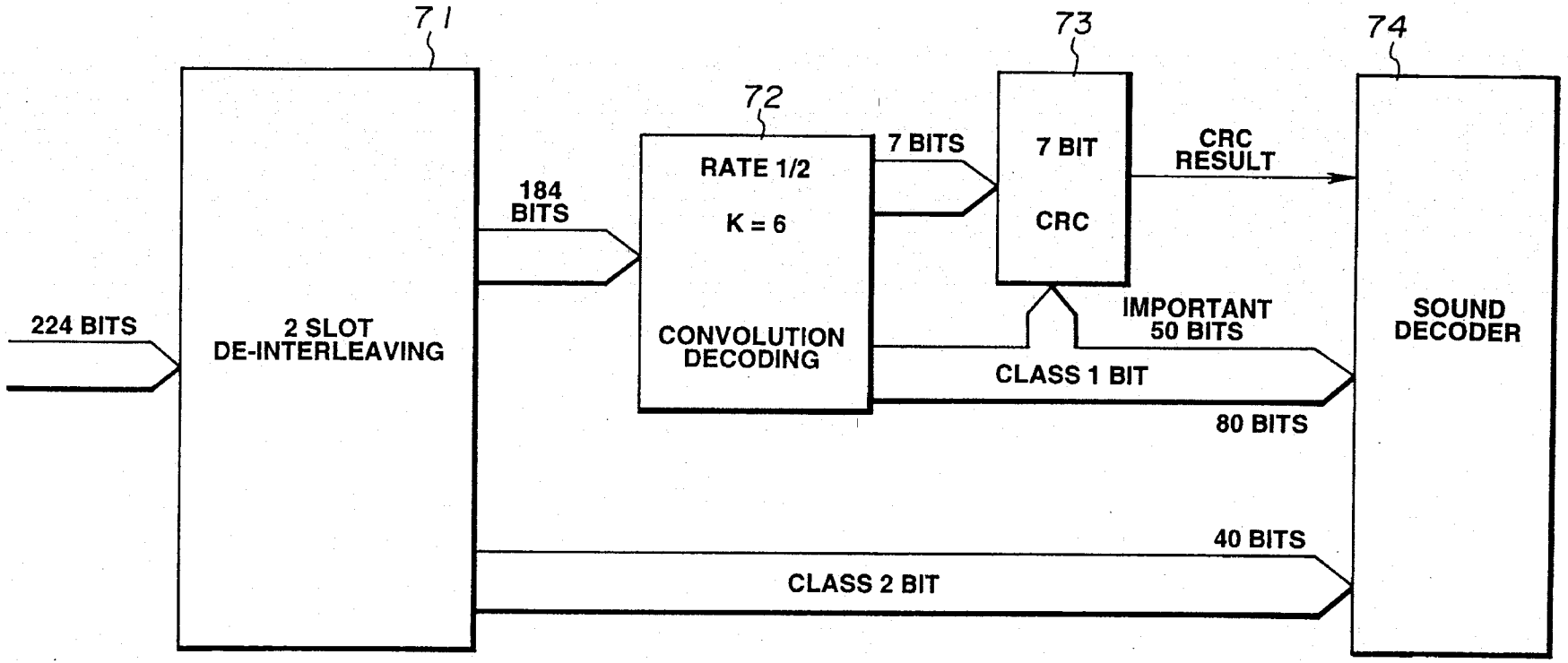
FIG. 17 is a view for illustrating CRC detection and convolution decoding.

The operation of the above-mentioned Viterbi decoding and CRC detection in the compressed speech signal decoder in the expander will be described next with reference to FIG. 17, which is a functional block diagram for illustrating the operation of the Viterbi decoding and the CRC detection. In this, a frame of 40 msec, consisting of two sub-frames of 20 msec each, is used as the unit to which the processing is applied.

First, a block of 224 bits transmitted by the compressor is received by a two-lot de-interleaving unit 71, which de-interleaves the block to restore the original sub-frames.

Then, convolution decoding is implemented by a convolution decoder 72, to produce 80 class-1 bits and 7 CRC bits. The Viterbi algorithm is used to perform the convolution decoding.

Also, the 50 bits class-1 bits that are particularly significant in terms of the human sense of hearing are fed into the CRC calculation block 73, where the 7 CRC bits are calculated for use in detecting whether all the errors in the 50 bits have been corrected. The input function is as follows:

$$a'(X) = CL_1[83]X^{49} + CL_1[4]X^{48} + CL_1[82]X^{47} \ldots \quad (20)$$
$$\ldots CL_1[27]X^2 + CL_1[59]X^1 + CL_1[28]X^0$$

A calculation similar to that in the compressor is performed using formulas (9) and (11) for the generating function and the parity function, respectively. The CRC found by this calculation and the received CRC code b'(x) from the convolution decoder are compared. If the CRC and the received CRC code b'(x) are identical, it is assumed that the bits subject to CRC coding have no errors. On the other hand, if the CRC and the received CRC code b'(x) are not identical, it is assumed that the bits subject to CRC coding include an error.

When an error is detected in the particularly-significant bits subject to CRC coding, using the bits including an error for expansion will cause a serious degradation of the sound quality. Therefore, when errors are detected, the sound processor performs masking processing in accordance with continuity of the detected errors.

The masking processing will now be described. In this, the data of a frame determined by the CRC calculation block 73 as including a CRC error is interpolated when such a determination is made.

In the present embodiment, the technique of bad frame masking is selectively employed for this masking processing.

Figure 18:
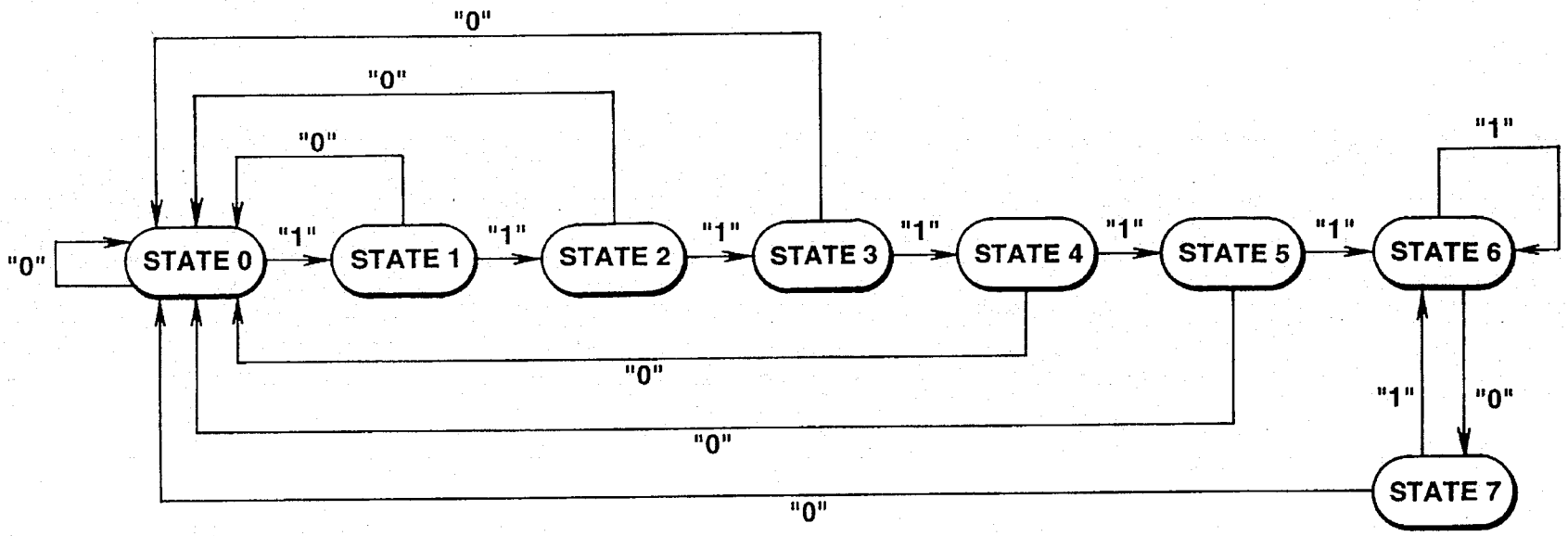
FIG. 18 is a view of state transition for illustrating bad frame masking processing.

FIG. 18 shows the error state transitions in the masking processing performed using the bad frame masking technique.

In FIG. 18, every time a frame of 20 msec of the compressed speech signal is decoded, each of the error states between error state 0 and error state 7 is shifted in the direction indicated by one of the arrows. A "1" on an arrow is a flag indicating that a CRC error has been detected in the current frame of 20 msec, while a "0" is a flag indicating that a CRC error has not been detected in the current frame 20 msec.

Normally, "error state 0" indicates that there is no CRC error. However, each time an error is detected in the current frame, the error state(s) shifts one state to the right. The shifting is cumulative. Therefore, for example, the error state shifts to "error state 6" if a CRC error is detected in at least six consecutive frames. The processing performed depends on the error state reached. At "error state 0," no processing is conducted. That is, normal decoding is conducted. When the error state reaches "state 1" and "state 2," frame iteration is conducted. When the error state reaches "state 2," "state 3" and "state 5," iteration and attenuation are conducted.

When the error state reaches "state 3," the frame is attenuated to 0.5 times, thus lowering the sound volume. When the error state reaches "state 4", the frame is attenuated to 0.25 times, thus further lowering the sound volume. When the error state reaches "state 5," the frame is attenuated to 0.125 times.

When the error state reaches "state 6" and "state 7," the sound output is fully muted.

The frame iteration in "state 1" and "state 2" is conducted on the pitch information, the V/UV discriminating information, and the spectral amplitude data in the following manner. The pitch information of the preceding frame is used again. Also, the V/UV discriminating information of the preceding frame is used again. In addition, the spectral amplitude data of the preceding frame are used again, regardless of any inter-frame differences.

When normal expansion is restored following frame iteration, the first and second frames will normally be expanded by not taking the inter-frame difference in the spectral amplitude data. However, if the inter-frame difference is taken, the expansion method is changed, depending on the change in the size of the spectral envelope.

Normally, if the change is in the direction of smaller size, normal expansion is implemented, whereas (1) if the change is in the direction of increasing size, the residual component alone is taken, and (2) the past integrated value is set to 0.

The increase and decrease in the change is monitored for up to the second frame following the return from iteration. If the change is increased in the second frame, the result of changing the decoding method for the first frame to method (2) is reflected.

The processing of the first and second frame following a return from iteration will now be described in detail, with reference to FIG. 19.

Figure 19:
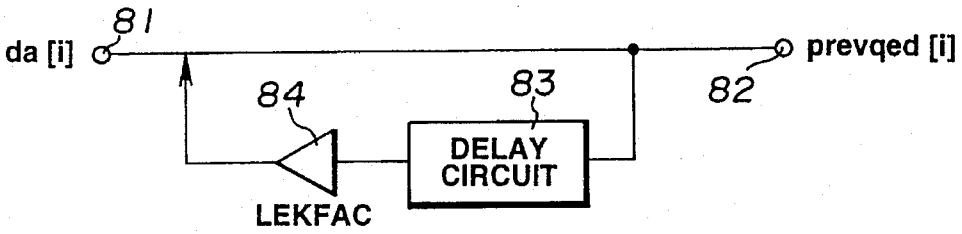
FIG. 19 is a view for illustrating bad frame masking processing.

In FIG. 19, the difference value $d_a[i]$ is received via the input terminal 81. This difference value $d_a[i]$ is leaky and has a certain degree of absolute components. The output spectrum prevqed[i] is fed to the output terminal 82.

First, the delay circuit 83 determines whether or not there is at least one element of the output spectrum prevqed[i] larger than the corresponding element of the preceding output spectrum $prevqed^{-1}[i]$, by deciding whether or not there is at least one value of i satisfying the following formula:

$$d_a[i]+prevqed^{-1}[i]*LEAKFAK-prevqed^{-1}[i]>0 (i=1 \text{ to } 44) \quad (21)$$

If there is a value of i satisfying formula (21), Sumda=1. Otherwise, Sumda=0.

For the first frame following an error: (22)

if Sumda $=0$, prevqed[$i$] $\leftarrow d_a[i]+\text{prevqed}^{-1}[i]*LEAKFAK$ $d_{aOLD}[i] \leftarrow d_a[i]$ On the other hand, (23)

if Sumda $=1$, prevqed[$i$] $\leftarrow d_a[i]$ $d_{aOLD}[i] \leftarrow d_a[i]$

For the second frame following an error: (24)

if Sumda $=0$ prevqed[$i$] $\leftarrow d_a[i]+\text{prevqed}^{-1}[i]*LEAKFAK$

On the other hand, (25)

if Sumda $=1$, prevqed[$i$] $\leftarrow d_a[i]$

For the third and subsequent frames, (26)

the following is adopted.

prevqed[$i$]

$\leftarrow d_a[i]+\text{prevqed}^{-1}[i]*LEAKFAK$

As has been described above, in the compressor of the MBE vocoder to which the speech compression method according to the present invention is applied, the CRC error detection codes are added to the pitch information, the V/UV sound discriminating information and the upper-layer index of the hierarchical vector output data representing the spectral amplitude data, and the convolution coding thereof and of the upper bits of the lower-layer indices of the hierarchical vector output data representing the spectral amplitude data, it is possible to transmit to the expander a compressed signal that is highly resistant to errors in the transmission path.

In addition, in the expander of the MBE vocoder to which the compressed speech signal decoding method according to another aspect of the present invention is applied, the compressed signal transmitted from the compressor, that is, the pitch information, the V/UV sound discriminating information, and the hierarchical vector output data representing the spectral amplitude data, which are strongly protected against errors in the transmission path, are processed by error correction decoding and then by CRC error detection, to be processed by bad frame masking in accordance with the results of the CRC error detection. Therefore, it is possible to produce speech with a high transmission quality.

Figure 20:
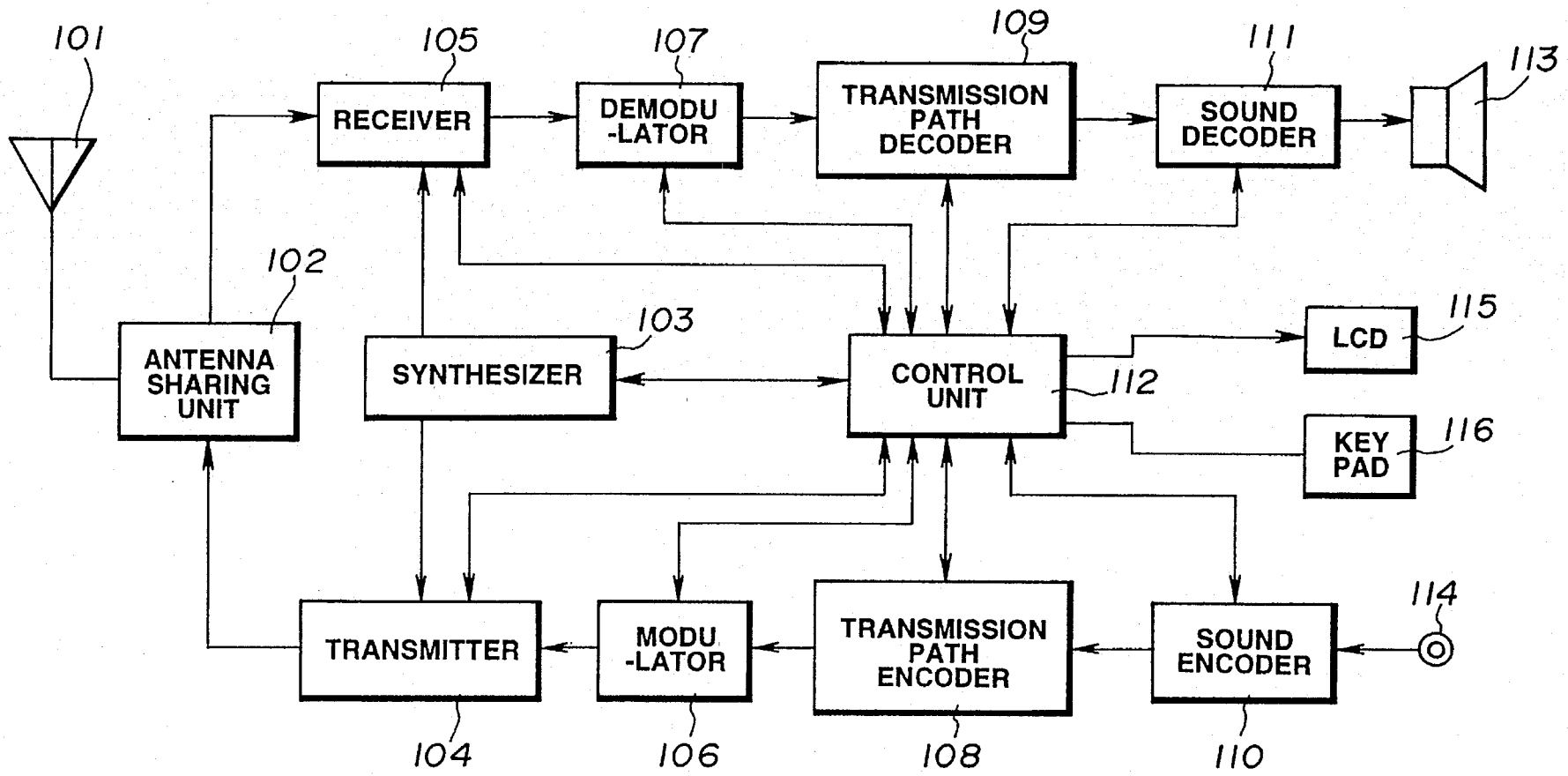
FIG. 20 is block diagram showing the arrangement of a portable telephone.

FIG. 20 shows an example in which the compression speech signal encoding method and the compressed speech signal decoding method according to the present invention are applied to an automobile telephone device or a portable telephone device, hereinafter referred to as a portable telephone.

During transmission, a speech signal from the microphone 114 is converted into a digital signal that is compressed by the speech compressor 110. The compressed speech signal is processed by the transmission path encoder 108 to prevent reductions in the quality of the transmission path from affecting the sound quality. After that, the encoded signal is modulated by the modulator 106 for transmission by the transmitter 104 from the antenna 101 via the antenna sharing unit 102.

During reception, radio waves captured by the antenna 101 are received by the receiver 105 through the antenna sharing unit 102. The received radio waves are demodulated by the demodulator 107, and the errors added thereto in the transmission path are corrected as much as possible by a transmission path decoder 109. The error-corrected compressed speech signal is expanded by a speech expander 111. The resulting digital speech signal is returned to an analog signal, which is reproduced by the speaker 113.

The controller 112 controls each of the above-mentioned parts. The synthesizer 103 supplies data indicating the transmission/reception frequency to the transmitter 104 and the receiver 105. The LCD display 115 and the key pad 116 provide a user interface.

The following three measures are employed to reduce the effect of transmission path errors on the compressed speech signal:

(i) rate ½ convolution code for protecting bits (class 1) of the compressed speech signal which are susceptible to error;

(ii) interleaving bits of the frames of the compressed speech signal across two time slots (40 msec) to reduce the audible effects caused by burst errors; and (iii) using CRC code to detect MBE parameter errors that are particularly significant in terms of the human sense of hearing.

Figure 21:
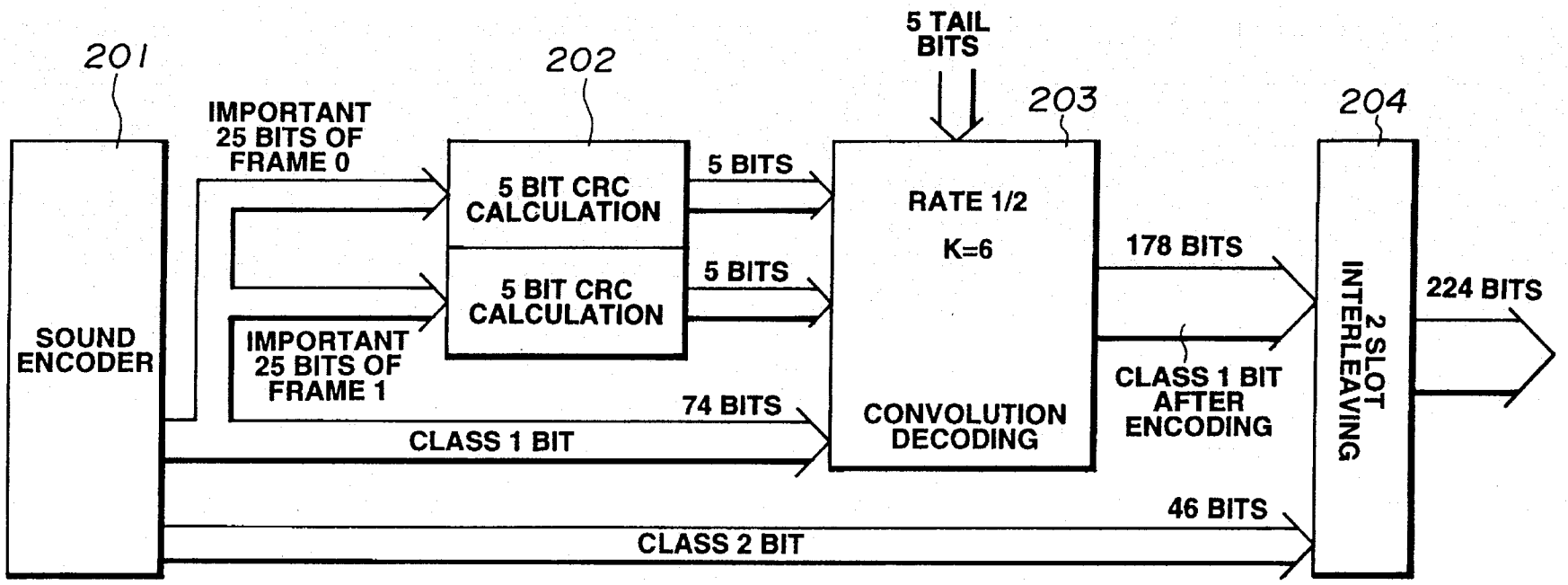
FIG. 21 is a view illustrating the channel encoder of the portable telephone shown in FIG. 20.
Figure 22:
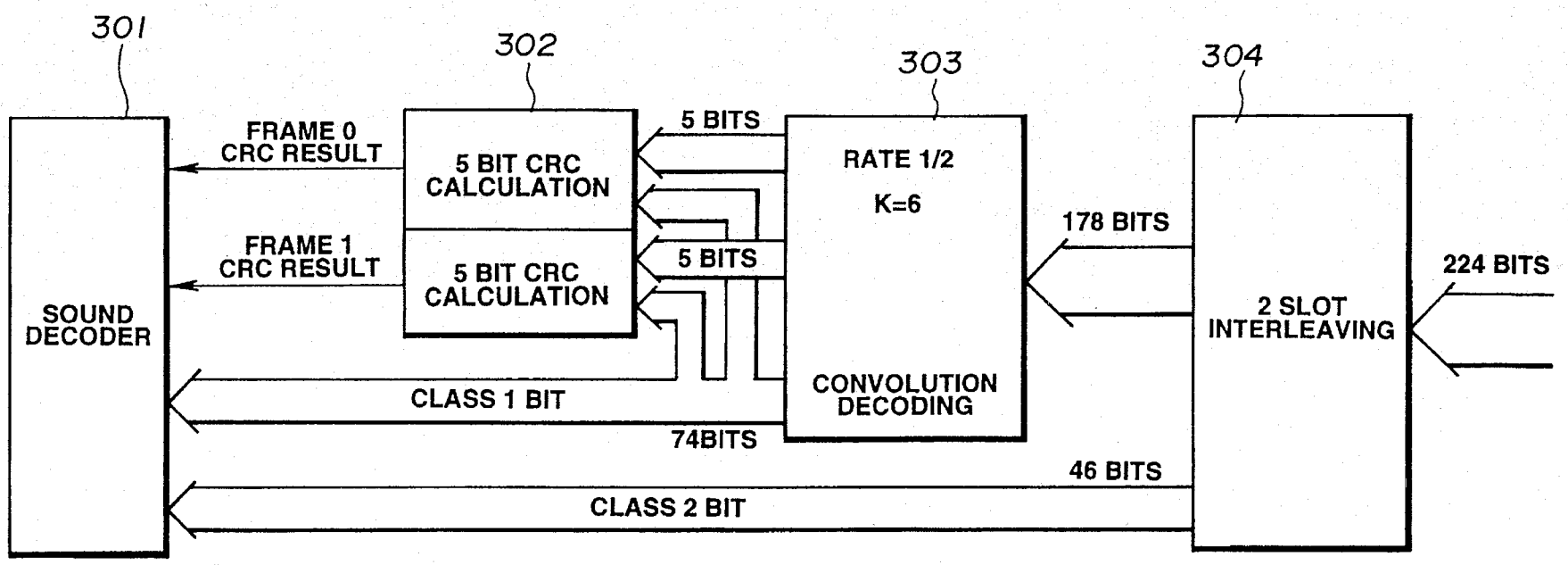
FIG. 22 is a view illustrating the channel decoder of the portable telephone shown in FIG. 20.

FIG. 21 shows an arrangement of the transmission path encoder 108, hereinafter referred to as the channel encoder. FIG. 22 shows an arrangement of the transmission path decoder 109, hereinafter referred to as the channel decoder. The speech compressor 201 performs compression on units of one sub-frame, whereas the channel encoder 108 operates on units of one frame. The channel encoder 108 performs encoding for error detection by CRC on units of 60 bits/sub-frame from the speech compressor 201, and error detection by convolution coding on units of 120 bits/frame, or two sub-frames.

The convolution coding error correction encoding carried out by the channel encoder 108 is applied to units of plural sub-frames (two sub-frames in this case) processed by the CRC error detection encoding.

First, referring to FIG. 21, the 120 bits of two sub-frames from the speech compressor 201 are divided into 74 class-1 bits, which are more significant in terms of the human sense of hearing, and into 46 class-2 bits.

Table 4 shows bit allocation for each class of the bits generated by the speech compressor.

TABLE 4

| Parameter Name | Total Bit Number | CRC Target Bit | Class 1 | Class 2 |
|---|---|---|---|---|
| PITCH | 8 | 8 | 8 | 0 |
| V/UV | 4 | 4 | 4 | 0 |
| Y GAIN | 5 | 5 | 5 | 0 |
| Y SHAPE | 8 | 8 | 8 | 0 |
| $R_{VQ1}$ | 6 | 0 | 3 | 3 |
| $R_{VQ2}$ | 5 | 0 | 2 | 3 |
| $R_{VQ3}$ | 5 | 0 | 2 | 3 |
| $R_{VQ4}$ | 5 | 0 | 2 | 3 |
| $R_{VQ5}$ | 5 | 0 | 1 | 4 |
| $R_{VQ6}$ | 5 | 0 | 1 | 4 |
| $R_{VQ7}$ | 4 | 0 | 1 | 3 |

In Table 4, the class-1 bits are protected by convolution code, while the class-2 bits are directly transmitted without being protected.

The bit order of the class-1 bits and the bit order of the class-2 bits are shown in Tables 5 and 6, respectively.

TABLE 5

| $CL_1[i]$ | Sub-Frame | Name | Index | $CL_1[i]$ | Sub-Frame | Name | Index |
|---|---|---|---|---|---|---|---|
| 0 | 0 | CRC | 4 | 45 | 0 | $R_{VQ4}$ | 3 |
| 1 | 0 | CRC | 2 | 46 | 1 | $R_{VQ4}$ | 4 |
| 2 | 0 | CRC | 0 | 47 | 1 | $R_{VQ3}$ | 3 |
| 3 | 1 | CRC | 3 | 48 | 0 | $R_{VQ3}$ | 4 |
| 4 | 1 | CRC | 1 | 49 | 0 | $R_{VQ2}$ | 3 |
| 5 | 0 | PITCH | 7 | 50 | 1 | $R_{VQ2}$ | 4 |
| 6 | 1 | PITCH | 6 | 51 | 1 | $R_{VQ1}$ | 3 |
| 7 | 1 | PITCH | 5 | 52 | 0 | $R_{VQ1}$ | 4 |
| 8 | 0 | PITCH | 4 | 53 | 0 | $R_{VQ1}$ | 5 |
| 9 | 0 | PITCH | 3 | 54 | 1 | YS | 0 |
| 10 | 1 | PITCH | 2 | 55 | 1 | YS | 1 |
| 11 | 1 | PITCH | 1 | 56 | 0 | YS | 2 |
| 12 | 0 | PITCH | 0 | 57 | 0 | YS | 3 |
| 13 | 0 | V/UV | 3 | 58 | 1 | YS | 4 |
| 14 | 1 | V/UV | 2 | 59 | 1 | YS | 5 |
| 15 | 1 | V/UV | 1 | 60 | 0 | YS | 6 |
| 16 | 0 | V/UV | 0 | 61 | 0 | YS | 7 |
| 17 | 0 | YG | 4 | 62 | 1 | YG | 0 |
| 18 | 1 | YG | 3 | 63 | 1 | YG | 1 |
| 19 | 1 | YG | 2 | 64 | 0 | YG | 2 |
| 20 | 0 | YG | 1 | 65 | 0 | YS | 3 |
| 21 | 0 | YG | 0 | 66 | 1 | YG | 4 |
| 22 | 1 | YS | 7 | 67 | 1 | V/UV | 0 |
| 23 | 1 | YS | 6 | 68 | 0 | V/UV | 1 |
| 24 | 0 | YS | 5 | 69 | 0 | V/UV | 2 |
| 25 | 0 | YS | 4 | 70 | 1 | V/UV | 3 |
| 26 | 1 | YS | 3 | 71 | 1 | PITCH | 0 |
| 27 | 1 | YS | 2 | 72 | 0 | PITCH | 1 |
| 28 | 0 | YS | 1 | 73 | 0 | PITCH | 2 |
| 29 | 0 | YS | 0 | 74 | 1 | PITCH | 3 |
| 30 | 1 | $R_{VQ1}$ | 5 | 75 | 1 | PITCH | 4 |
| 31 | 1 | $R_{VQ1}$ | 4 | 76 | 0 | PITCH | 5 |
| 32 | 0 | $R_{VQ1}$ | 3 | 77 | 0 | PITCH | 6 |
| 33 | 0 | $R_{VQ2}$ | 4 | 78 | 1 | PITCH | 7 |
| 34 | 1 | $R_{VQ2}$ | 3 | 79 | 1 | CRC | 0 |
| 35 | 1 | $R_{VQ3}$ | 4 | 80 | 1 | CRC | 2 |
| 36 | 0 | $R_{VQ3}$ | 3 | 81 | 0 | CRC | 4 |
| 37 | 0 | $R_{VQ4}$ | 4 | 82 | 1 | CRC | 1 |
| 38 | 1 | $R_{VQ4}$ | 3 | 83 | 0 | CRC | 3 |
| 39 | 1 | $R_{VQ5}$ | 4 | 84 | — | TAIL | 0 |
| 40 | 0 | $R_{VQ6}$ | 4 | 85 | — | CRC | 1 |
| 41 | 0 | $R_{VQ7}$ | 3 | 86 | — | TAIL | 2 |
| 42 | 1 | $R_{VQ6}$ | 3 | 87 | — | TAIL | 3 |
| 43 | 1 | $R_{VQ6}$ | 4 | 88 | — | TAIL | 4 |
| 44 | 0 | $R_{VQ5}$ | 4 | | | | |

YG and YS are abbreviations for Y gain and Y shape, respectively.

TABLE 6

| $CL_2[i]$ | Sub-Frame | Name | Index | $CL_2[i]$ | Sub-Frame | Name | Index |
|---|---|---|---|---|---|---|---|
| 0 | 0 | $R_{VQ1}$ | 2 | 23 | 0 | $R_{VQ7}$ | 0 |
| 1 | 1 | $R_{VQ1}$ | 1 | 24 | 0 | $R_{VQ7}$ | 1 |
| 2 | 1 | $R_{VQ1}$ | 0 | 25 | 1 | $R_{VQ7}$ | 2 |
| 3 | 0 | $R_{VQ2}$ | 2 | 26 | 1 | $R_{VQ6}$ | 0 |
| 4 | 0 | $R_{VQ2}$ | 1 | 27 | 0 | $R_{VQ6}$ | 1 |
| 5 | 1 | $R_{VQ2}$ | 0 | 28 | 0 | $R_{VQ6}$ | 2 |
| 6 | 1 | $R_{VQ3}$ | 2 | 29 | 1 | $R_{VQ6}$ | 0 |
| 7 | 0 | $R_{VQ3}$ | 1 | 30 | 1 | $R_{VQ5}$ | 1 |
| 8 | 0 | $R_{VQ3}$ | 0 | 31 | 0 | $R_{VQ5}$ | 2 |
| 9 | 1 | $R_{VQ4}$ | 2 | 32 | 0 | $R_{VQ5}$ | 0 |
| 10 | 1 | $R_{VQ4}$ | 1 | 33 | 1 | $R_{VQ5}$ | 1 |
| 11 | 0 | $R_{VQ4}$ | 0 | 34 | 1 | $R_{VQ4}$ | 2 |
| 12 | 0 | $R_{VQ5}$ | 3 | 35 | 0 | $R_{VQ4}$ | 0 |
| 13 | 1 | $R_{VQ3}$ | 2 | 36 | 0 | $R_{VQ4}$ | 1 |
| 14 | 1 | $R_{VQ5}$ | 1 | 37 | 1 | $R_{VQ3}$ | 2 |
| 15 | 0 | $R_{VQ5}$ | 0 | 38 | 1 | $R_{VQ3}$ | 0 |
| 16 | 0 | $R_{VQ6}$ | 3 | 39 | 0 | $R_{VQ3}$ | 1 |
| 17 | 1 | $R_{VQ6}$ | 2 | 40 | 0 | $R_{VQ2}$ | 0 |
| 18 | 1 | $R_{VQ5}$ | 1 | 41 | 1 | $R_{VQ2}$ | 1 |
| 19 | 0 | $R_{VQ6}$ | 0 | 42 | 1 | $R_{VQ2}$ | 2 |
| 20 | 0 | $R_{VQ7}$ | 2 | 43 | 0 | $R_{VQ1}$ | 0 |

TABLE 6-continued

| $CL_2[i]$ | Sub-Frame | Name | Index | $CL_2[i]$ | Sub-Frame | Name | Index |
|---|---|---|---|---|---|---|---|
| 21 | 1 | $R_{VQ7}$ | 1 | 44 | 0 | $R_{VQ1}$ | 1 |
| 22 | 1 | $R_{VQ7}$ | 0 | 45 | 1 | $R_{VQ1}$ | 2 |

The class-1 array in Table 5 is denoted by $CL_1[i]$, in which the element number i=0 to 88. The class-2 array in Table 6 is denoted by $CL_2[i]$, in which i=0 to 45. The first columns of Tables 5 and 6 indicate the element number i of the input arrays $CL_1[i]$and $CL_2[i]$. The second columns of Tables 5 and 6 indicate the sub-frame number. The third columns indicate the parameter name, and the fourth columns indicate the bit position within the parameter, with 0 indicating the least significant bit.

First, the 25 bits that are particularly significant in terms of the human sense of hearing are divided out of the class-1 bits of each of the two sub-frames constituting the frame. Of the two sub-frames, the temporally earlier one is sub-frame 0, while the temporally later one is sub-frame 1. These particularly-significant bits are fed into the CRC calculation block 202, which generates 5 bits of CRC code for each sub-frame. The CRC code generating function $g_{crc}(X)$ for both sub-frame 0 and sub-frame 1 is as follows:

$$g_{crc}(X)=1+X^3+X^5 \tag{27}$$

If the input bit array to the convolution encoder 203 is denoted by $CL_1[i]$, in which the element number i=0 to 88 as shown in Table 4, the following formula (28) is employed as the input function $a_0(X)$ for sub-frame 0, and the following formula (29) is employed as the input function $a_0(X)$ for sub-frame 1;

$$\begin{aligned} a_0(X) &= CL_1[5]X^{24}+CL_1[76]X^{23}+CL_1[9]X^{22}\ldots \\ &\quad \ldots CL_1[73]X^2+CL_1[8]X^1+CL_1[77]X^0 \end{aligned} \tag{28}$$

$$\begin{aligned} a_1(X) &= CL_1[78]X^{24}+CL_1[7]X^{23}+CL_1[74]X^{22}\ldots \\ &\quad \ldots CL_1[10]X^2+CL_1[75]X^1+CL_1[6]X^0 \end{aligned} \tag{29}$$

If the quotients of sub-frame 0 and sub-frame 1 are $q_0(X)$ and $q_1(X)$, respectively, the following formulas (30) and (31) are employed for the parity functions $b_0(X)$ and $b_1(X)$, which are remainders of the input functions:

$$a_0(X)\cdot X^5/g_{crc}(X)=q_0(x)+b_0(x)/g_{crc}(X) \tag{30}$$

$$a_1(X)\cdot X^5/g_{crc}(X)=q_1(x)+b_1(x)/g_{crc}(X) \tag{31}$$

The resulting parity bits $b_0(X)$ and $b_1(X)$ are incorporated into the array $CL_1[i]$using the following formulas (32) and (33):

$$\begin{aligned} b_0(X) &= CL_1[0]X^4+CL_1[83]X^3+CL_1[1]X^2+ \\ &\quad CL_1[82]X^1+CL_1[2]X^0 \end{aligned} \tag{32}$$

$$\begin{aligned} b_1(X) &= CL_1[81]X^4+CL_1[3]X^3+CL_1[80]X^2+ \\ &\quad CL_1[4]X^1+CL_1[79]X^0 \end{aligned} \tag{33}$$

Then, the 74 class-1 bits and 10 bits generated by the calculations performed by the CRC calculation block 202 are fed to the convolution coder 203 in the input order shown in Table 5. In the convolution coder, these bits are processed by convolution coding of rate ½ and the constraint length 6 (=k). The generating functions used in this convolution coding are the following formulas (34) and (35):

$$g_0(D)=1+D+D^3+D^5 \quad (34)$$

$$g_1(D)=1+D^2+D^3+D^4+D^5 \quad (35)$$

Of the input bits to the convolution coder in Table 5, the 74 bits $CL_1[5]$ to $CL_1[78]$ are class-1 bits, and the 10 bits $CL_1[0]$ to $CL_1[4]$ and $CL_1[79]$ to $CL_1[83]$ are CRC bits. The 5 bits $CL_1[84]$ to $CL_1[88]$ are tail bits all with the value of 0 for returning the encoder to its initial state.

The convolution coding starts with $g_0(D)$, and coding is carried out alternately using the above-mentioned two formulas (34) and (35). The convolution encoder 203 is constituted by a 5-stage shift register operating as a delay element, as shown in FIG. 14, and may produce an output by calculating the exclusive OR of the bits corresponding to the coefficients of the generating functions. As a result, an output of two bits $cc_0[i]$ and $cc_1[i]$ is produced from the input $CL_1[i]$. Therefore, an output of 178 bits is produced as a result of convolution coding all the class-1 bits.

The total of 224 bits, consisting of the 178 bits resulting from convolution coding the class-1 bits, and the 46 class-2 bits are fed to the two-slot interleaving section 204, which performs bit interleaving and frame interleaving across two frames, and feeds the resulting bit stream to the modulator 106 in a predetermined order.

Referring to FIG. 22, the channel decoder 109 will now be described.

The channel decoder decodes the bit stream received from the transmission path using a process that is the reverse of that performed by the channel encoder 108. The received bit stream for each frame is stored in the de-interleaving block 304, where de-interleaving is performed on the received frame and the preceding frame to restore the original frames.

The convolution decoder 303 performs convolution decoding to generate the 74 class-1 bits and the 5 CRC bits for each sub-frame. The Viterbi algorithm is employed to perform the convolution decoding.

Also, the 50 class-1 bits that are particularly significant in terms of the human sense of hearing are fed into the CRC calculation block 302, which calculates 5 CRC bits for each sub-frame for detecting, for each sub-frame, that all the errors in the 25 particularly-significant bits in the sub-frame have been corrected.

The above-mentioned formula (9), as used in the encoder, is employed as the CRC code generating function. If the output bit array from the convolution decoder is denoted by $CL_1'[i]$, in which i=0 to 88, the following formula (36) is used for the input function of the CRC calculation block 302 for sub-frame 0, whereas the following formula (37) is used for the input function of the CRC calculation block 302 for sub-frame 1. In this case, $CL_1[i]$ in Table 5 is replaced by $CL_1'[i]$.

$$\begin{aligned} a_0'(X) &= CL_1'[5]X^{24}+CL_1'[76]X^{23}+CL_1'[9]X^{22}\ldots \\ &\quad \ldots CL_1'[73]X^2+CL_1'[8]X^1+CL_1'[77]X^0 \end{aligned} \quad (36)$$

$$\begin{aligned} a_1'(X) &= CL_1'[78]X^{24}+CL_1'[7]X^{23}+CL_1'[74]X^{22}\ldots \\ &\quad \ldots CL_1'[10]X^2+CL_1'[75]X^1+CL_1'[6]X^0 \end{aligned} \quad (37)$$

If the quotients of sub-frame 0 and sub-frame 1 are denoted by $q_{d0}(X)$ and $q_{d1}(X)$, respectively, the following formulas (38) and (39) are employed for parity functions $b_{d0}(X)$ and $b_{d1}(X)$, which are remainders of the input functions:

$$a_0'(X)\cdot X^5/g_{crc}(X)=q_{d0}(x)+b_{d0}(x)/g_{crc}(X) \quad (38)$$

$$a_1'(X)\cdot X^5/g_{crc}(X)=q_{d1}(x)+b_{d1}(x)/g_{crc}(X) \quad (39)$$

The CRCs of sub-frame 0 and sub-frame 1 are extracted from the output bit array in accordance with Table 5 and are compared with $b_0'(X)$ and $b_1'(X)$ calculated by the CRC calculation block 302. Also, the CRCs calculated by the CRC calculation block are compared with $b_{d0}(X)$ and $b_{d1}(X)$ for each sub-frame. If they are identical, it is assumed that the particularly-significant bits of the sub-frame that are protected by the CRC code have no errors. If they are not identical, it is assumed that the particularly-significant bits of the sub-frame include errors. When the particularly-significant bits include an error, using such bits for expansion will cause a serious degradation of the sound quality. Therefore, when errors are detected, the sound decoder 301 performs masking processing in accordance with continuity of the detected errors. In this, the sound decoder 301 replaces the bits of the sub-frame in which the error is detected with the bits of the preceding frame, or bad frame masking is carried out so that the decoded speech signal is attenuated.

As has been described above, in the example in which the compressed speech signal encoding method according to the present invention and the compressed speech signal decoding method according to another aspect of the present invention are applied to the portable telephone, error detection is carried out over a short time interval. Therefore, it is possible to reduce the loss of information that results from performing correction processing on those frame in which an uncorrected error is detected.

Also, since error correction is provided for burst errors affecting plural sub-frames, it is possible to improve the quality of the reproduced speech signal.

In the description of the arrangement of the compressor of the MBE vocoder shown in FIG. 1, and of the arrangement of the expander shown in FIG. 15, each section is described in terms of hardware. However, it is also possible to realize the arrangement by means of a software program running on a digital signal processor (DSP).

As described above, in the compressed speech signal encoding method according to the present invention, the CRC error detection codes are added to the pitch information, the V/UV sound discriminating information and the upper-layer index of the hierarchical vector output data representing the spectral envelope, which are then convolution-encoded together with the upper bits of the lower-layer indices of the hierarchical vector output data representing the spectral envelope. Therefore, it is possible to strongly protect the compressed signal to be transmitted to the expander from errors in the transmission path.

In addition, in the compressed speech signal decoding method according to another aspect of the present invention, the pitch information, the V/UV sound discriminating information, and the hierarchical vector output data representing the spectral envelope in the compressed speech signal received from the compressor are strongly protected, and are processed by error correction decoding and then by CRC error detection. The decoded compressed speech signal is processed using bad frame masking in accordance with the result of the CRC error detection. Therefore, it is possible to produce speech with a high transmission quality.

Further, in the error correction coding applied in the compressed speech signal encoding method, convolution encoding is carried out on units of plural frames that have been processed by the CRC error detection encoding. Therefore, it is possible to reduce the loss of information due to the performing error correction processing on a frame in which an uncorrected error is detected, and to carry out error correction of burst errors affecting plural frame thus further improving the decoded speech.

We claim:

1. A method for encoding a compressed digital signal to provide a transmission signal resistant to transmission channel errors, the compressed digital signal being derived from a digital speech signal by dividing the digital speech signal in time to provide a signal block, orthogonally transforming the signal block to provide spectral data on the frequency axis, and using multi-band excitation to determine from the spectral data whether each of plural bands obtained by a pitch-dependent division of the spectral data in frequency represents one of a voiced (V) and an unvoiced (UV) sound, and to derive from the spectral data a spectral amplitude for each of a predetermined number of bands obtained by a fixed division of the spectral data by frequency, each spectral amplitude being a component of the compressed signal, the method comprising the steps of:

performing hierarchical vector quantizing to quantize the spectral amplitude of each of the predetermined number of bands to provide an upper-layer index, and to provide lower-layer indices fewer in number than the predetermined number of bands;

applying convolution coding to the upper-layer index to encode the upper-layer index for error correction, and to provide an error correction-coded upper-layer index; and including the error correction-coded upper-level index and the lower-level indices in the transmission signal.

2. The method of claim 1, wherein:

the step of performing hierarchical vector quantizing generates lower-level indices including higher-order bits and lower-order bits; and in the step of applying convolution coding, convolution coding is additionally applied to the higher-order bits of the lower-layer indices, and is not applied to the lower-order bits of the lower-layer indices.

3. The method of claim 2, wherein the multi-band excitation is additionally used to determine pitch information for the signal block, the pitch information being additionally a component of the compressed signal, and determining whether each of the plural bands represents one of a voiced (V) and an unvoiced (UV) sound generates V/UV information for each of the plural bands, the V/UV information for each of the plural bands being additionally a component of the compressed signal, and wherein:

in the step of applying convolution coding, convolution coding is additionally applied to the pitch information and to the V/UV information for each of the plural bands.

4. The method of claim 3, wherein:

the method additionally comprises the step of coding the pitch information, the V/UV information for each of the plural bands, and the upper-layer index for error detection using cyclic redundancy check (CRC) error detection coding to provide CRC-processed pitch information, V/UV information for each of the plural bands, and upper-layer index; and the step of applying convolution coding applies convolution coding to the CRC-processed pitch information, V/UV information for each of the plural bands, and upper-layer index, together with the higher-order bits of the lower-layer indices.

5. The method of claim 4, wherein the digital speech signal is divided in time additionally to provide an additional signal block following the signal block at an interval of a frame, the frame being shorter than the signal block, and CRC-processed additional pitch information, additional V/UV information for each of plural bands, and additional upper-level index are derived from the additional signal block; and in the step of applying convolution coding, the convolution coding is applied to a unit composed of the CRC-processed pitch information, the V/UV information for each of the plural bands, the upper-level index, and the CRC-processed additional pitch information, additional V/UV information for each of plural bands, and additional upper-level index.

6. A method for decoding a transmission signal that has been coded to provide resistance to transmission errors, the transmission signal including frames composed of pitch information, voiced/unvoiced (V/UV) information for each of plural bands, an upper-layer index and lower-layer indices generated by hierarchical vector quantizing, the lower-layer indices including upper-order bits and lower-order bits, the pitch information, the V/UV information, and the upper-layer index being coded to generate codes for cyclic redundancy check (CRC) error detection, the pitch information, the V/UV information, the upper-layer index, the upper-order bits of the lower-layer indices, and the CRC codes being convolution-coded, the method comprising the steps of:

performing cyclic redundancy check (CRC) error detection on the pitch information, the V/UV information for each of plural bands, and the upper-layer index of each of the frames of the transmission signal;

performing interpolation processing on frames of the transmission signal detected by the step of performing CRC error detection as including an error; and applying hierarchical vector dequantizing to the upper-layer index and the lower-layer indices of each frame following convolution decoding to generate spectral amplitudes for a predetermined number of bands.

7. The decoding method of claim 6, additionally comprising steps of:

expanding the pitch information, the V/UV information, the upper-level index, and the lower-layer indices of consecutive frames to produce spectral envelopes for consecutive ones of the frames using an expansion method; and controlling the expansion method in response to a dimensional relationship between the spectral envelopes produced from the consecutive ones of the frames, the expansion method being controlled for a predetermined number of frames beginning with a first one of the consecutive ones of the frames in which no uncorrected errors are detected by the step of performing CRC error detection.

* * * * *